US010098430B2

(12) United States Patent
Pakr et al.

(10) Patent No.: US 10,098,430 B2
(45) Date of Patent: Oct. 16, 2018

(54) PROTECTION COVER

(71) Applicant: SAMSUNG ELECTRONICS CO., LTD., Suwon-si, Gyeonggi-do (KR)

(72) Inventors: Ki-Hyun Pakr, Suwon-si (KR); Jong-Hyun Park, Suwon-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/322,238

(22) PCT Filed: Jul. 7, 2014

(86) PCT No.: PCT/KR2014/006072
§ 371 (c)(1),
(2) Date: Dec. 27, 2016

(87) PCT Pub. No.: WO2016/006720
PCT Pub. Date: Jan. 14, 2016

(65) Prior Publication Data

US 2017/0127780 A1 May 11, 2017

(51) Int. Cl.

| | |
|---|---|
| ***A45C 13/00*** | (2006.01) |
| ***A45C 11/00*** | (2006.01) |
| ***A45F 5/00*** | (2006.01) |

(52) U.S. Cl.
CPC ..... *A45C 13/002* (2013.01); *A45C 11/00* (2013.01); *A45F 5/00* (2013.01); *A45C 2011/001* (2013.01); *A45C 2011/002* (2013.01); *A45C 2011/003* (2013.01)

(58) Field of Classification Search
CPC ..... A45F 5/00; A45C 13/002; A45C 11/00; A45C 2011/001; A45C 2011/002; A45C 2011/003
See application file for complete search history.

(56) References Cited

U.S. PATENT DOCUMENTS

| | | | | |
|---|---|---|---|---|
| 2007/0215493 | A1* | 9/2007 | Servis | A45C 11/04 206/5 |
| 2013/0200118 | A1* | 8/2013 | Johnson | A45C 11/00 224/246 |
| 2013/0270129 | A1* | 10/2013 | Johnson | A45C 11/38 206/216 |

(Continued)

FOREIGN PATENT DOCUMENTS

| | | |
|---|---|---|
| JP | 10-163646 | 6/1998 |
| JP | 2005-162178 | 6/2005 |

(Continued)

OTHER PUBLICATIONS

International Search Report for PCT/KR2014/006072 dated Mar. 31, 2015, 4 pages.

(Continued)

*Primary Examiner* — Corey Skurdal
(74) *Attorney, Agent, or Firm* — Nixon & Vanderhye, P.C.

(57) ABSTRACT

A protection cover, according to various embodiments of the present invention, protects an electronic device and may comprise: a cover unit for covering the electronic device; and a suction unit, provided at the cover unit, for fixing the cover unit including the electronic device to the outside. The device as described above may be implemented in more varied ways according to the embodiments.

10 Claims, 21 Drawing Sheets

(56) References Cited

U.S. PATENT DOCUMENTS

| | | | | |
|---|---|---|---|---|
| 2014/0319296 | A1* | 10/2014 | Clouser | H02J 7/0044<br>248/206.3 |
| 2015/0212544 | A1* | 7/2015 | Chen | G06F 1/1632<br>361/679.41 |
| 2016/0206065 | A1* | 7/2016 | Ehrlich | A45C 11/00 |
| 2016/0209881 | A1* | 7/2016 | Fenton | A45C 11/00 |

FOREIGN PATENT DOCUMENTS

| | | |
|---|---|---|
| KR | 10-2011-0027951 | 3/2011 |
| KR | 10-1183278 | 9/2012 |
| KR | 10-1197680 | 11/2012 |
| KR | 10-1369297 | 3/2014 |
| KR | 20-2014-0002815 | 5/2014 |
| KR | 20-0472573 | 5/2014 |

OTHER PUBLICATIONS

Written Opinion of the ISA for PCT/KR2014/006072 dated Mar. 31, 2015, 7 pages.

* cited by examiner

PROTECTION COVER

CROSS-REFERENCE TO RELATED APPLICATION

This application is a National Phase Entry of PCT International Application No. PCT/KR2014/006072, which designated the United States and which was filed on Jul. 7, 2014. The contents of this PCT application are incorporated herein by reference in their entirety.

TECHNICAL FIELD

Various embodiments of the present invention relate to a protection cover.

BACKGROUND ART

Users have recently been provided with various electronic devices, and there has recently been widespread use of electronic devices that can provide users with various contents while being carried, such as mobile phones, MP3 players, portable multimedia players (PMP), and electronic books. Such electronic devices not only have wireless transmitting/receiving functions, but also various integrated functions, such as pictures, music, moving pictures, multimedia, and games. A display portion is provided on the front surface of such an electronic device such that the above multifunctions can be used, and, in the case of a recent electronic device referred to as a smartphone, the entire front surface of the electronic device is configured as a large display portion that responds to touches.

Furthermore, as the electronic devices become compact and lightweight, users carry them with their hands, store them in their pockets or bags and use them on the move; as a result, there is a constant danger of loss and fracture resulting from storage and carriage. Therefore, various types of covers (hereinafter, referred to as "protection covers") have been mounted and used to safely protect the electronic devices.

For example, there is a type of protection cover that surrounds and covers only the edge of the exterior of an electronic device of the back surface thereof, and there also exists a flip cover-type protection cover. In the case of the type of protection cover that surrounds and covers only the edge of the exterior of an electronic device or the back surface thereof, the display portion side is exposed such that the user can instantly use the display portion of the electronic device, and the edge of the exterior of the electronic device or the back surface thereof is covered. In the case of the flip-type protection cover, a front cover and a back cover are provided such that both the front and back surfaces of the electronic device can be covered, and the front cover is rotatably connected to the back cover. Accordingly, the front cover rotates with regard to the back cover and is folded/unfolded such that the display portion of the electronic device is exposed/covered.

Meanwhile, a user of an electronic device may have some inconvenience when watching the screen on the display portion. When the user wants to use a multimedia function, for example, reproducing a moving picture, during a long trip, he/she needs to keep holding the electronic device to watch the moving picture.

DETAILED DESCRIPTION OF THE INVENTION

Technical Problem

When the user uses a multimedia function provided by the electronic device for a long time, he/she cannot watch the same without continuously holding the electronic device in his/her hands; this inconveniences the user who wants to watch multimedia using the electronic device.

In addition, when the protection cover includes a flip cover, the front cover, which covers the display portion, is provided to be able to rotate with regard to the back cover; as a result, various types of retaining devices are provided.

For example, a retaining portion, such as a ring or a magnet, is installed on the front cover side, and an engaging portion, which engages with the retaining portion such as a ring or a magnet, is installed on the back cover side; the front cover then can keep covering the display portion without playing.

However, such a retaining device may be easily released, when the electronic device is dropped, for example, failing to conduct the function of the front cover, i.e. the function of covering and protecting the display portion.

Therefore, various embodiments of the present invention seek to provide a protection cover configured such that, when the user uses a multimedia function and the like with an electronic device, the electronic device can be retained anywhere on a vertical surface, such as a wall surface.

In addition, various embodiments of the present invention seek to provide a protection cover, which enables the user to freely use both hands while the electronic device remains retained on a wall surface by the user, and which can have visual convenience and openness.

In addition, various embodiments of the present invention seek to provide a protection cover configured such that, when the protection cover includes a flip cover, the front cover is prevented from playing or detaching due to an external impact, such as a drop, thereby guaranteeing that the front cover maintains the function of protecting the display portion in any situation.

Technical Solution

In accordance with an embodiment among various embodiments of the present invention, there is provided a protection cover that protects an electronic device, and the protection cover may include: a cover portion that covers the electronic device; and an adsorption portion provided on the cover portion so as to retain the cover portion, which is provided with the electronic device, on an outer portion.

In accordance with an embodiment among various embodiments of the present invention, there is provided a protection cover that protects an electronic device, and the protection cover may include: a front cover positioned on a front surface of the electronic device; a back cover connected to the front cover and positioned on a back surface of the electronic device; and a connection member that rotatably connects the front cover to the back cover, wherein the protection cover may include an adsorption portion provided on the front cover and on the connection member so as to retain the cover portion, which is provided with the electronic device, on a vertical surface.

In accordance with an embodiment among various embodiments of the present invention, there is provided a protection cover that protects an electronic device, and the protection cover may include: a back housing that surrounds the electronic device and covers a back surface of the electronic device; a surface cover rotatably provided on a surface of the back housing so as to expose the surface of the back housing according to a rotation; and an adsorption portion provided on the surface of the back housing so as to retain the back housing, which is provided with the electronic device, on a vertical surface.

In accordance with an embodiment among various embodiments of the present invention, there is provided a protection cover, which may include: a front cover positioned on a front surface of an electronic device; a back housing that surrounds the electronic device and covers a back surface of the electronic device; a surface cover rotatably provided on a surface of the back housing so as to expose the surface of the back housing according to a rotation; and an adsorption portion provided on the surface of the back housing so as to retain the back housing, which is provided with the electronic device, on a vertical surface.

Advantageous Effects

A protection cover according to various embodiments of the present invention has an adsorption portion provided on the protection cover such that, when the user executes multimedia for a long time, the electronic device can be retained anywhere on a vertical surface, such as a wall surface.

In addition, a protection cover according to various embodiments of the present invention makes it possible to retain an electronic device anywhere on a vertical surface, such as a wall surface; accordingly, the electronic device can be retained within the user's field of view, thereby providing visual convenience; and the fact that the user can use both hands freely provides openness.

In addition, when a protection cover according to various embodiments of the present invention includes a flip cover, a dual adsorption portion, which is provided on an electronic cover, is adsorbed on a display portion, thereby preventing the front cover from playing or detaching due to an external impact, such as a drop; accordingly, the front cover can maintain the function of protecting the display portion in any situation of the electronic device.

In addition, a protection cover according to various embodiments of the present invention has an adsorption portion provided on a front cover, the adsorption portion having a mixed structure and including a second adsorption portion on the center portion and a first adsorption portion around the center portion, such that the adsorbing force exerted by the front cover can be adjusted stepwise.

Description of Reference Numerals

Figure 1A:
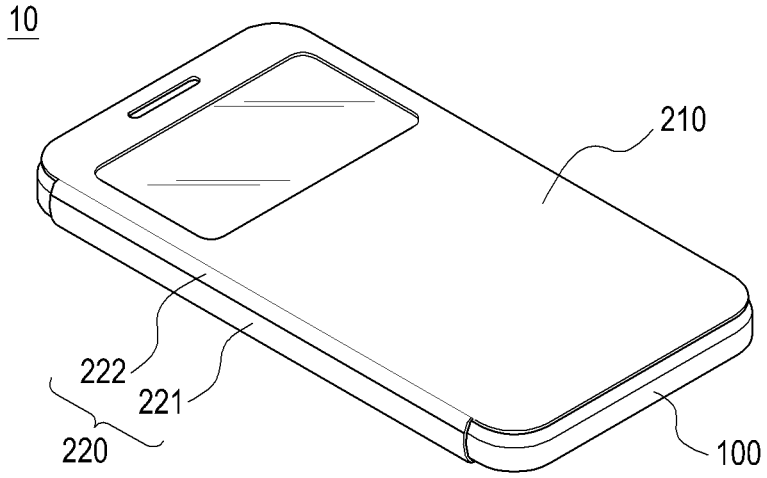
FIGS. 1A and 1B are perspective views of an electronic device having a protection cover according to the first embodiment among various embodiments of the present invention.

| | |
|---|---|
| 100: body portion | 110: display portion |
| 120: back case | 200: protection cover |
| 210: front cover | 220: connection member |
| 221: first split surface | 222: second split surface |
| 230: back cover | 250: back housing |

-continued

| Description of Reference Numerals | |
|---|---|
| 260: surface cover | 300: adsorption portion |
| 310: first adsorption portion | 320: second adsorption portion |

MODE FOR CARRYING OUT THE INVENTION

Hereinafter, various embodiments of the present invention will be described more fully in conjunction with the accompanying drawings. The present invention may have various embodiments, and modifications and changes may be made therein. Therefore, the present invention will be described in detail with reference to particular embodiments shown in the accompanying drawings. However, the description is not intended to limit the present invention to the specific embodiments, and it shall be appreciated that all the changes, equivalents and substitutions belonging to the idea and technical scope of the present invention are included in the present invention. In connection with descriptions of the drawings, like reference numerals designate like elements.

As used in various embodiments of the present invention, the expressions "include", "may include", and other conjugates refer to the existence of a corresponding disclosed function, operation, or constituent element, and do not limit one or more additional functions, operations, or constituent elements. Further, as used in various embodiments of the present invention, the terms "include", "have", and their conjugates are intended merely to denote a certain feature, numeral, step, operation, element, component, or a combination thereof, and should not be construed to initially exclude the existence of or a possibility of addition of one or more other features, numerals, steps, operations, elements, components, or combinations thereof.

Further, as used in various embodiments of the present invention, the expression "or" includes any or all combinations of words enumerated together. For example, the expression "A or B" may include A, may include B, or may include both A and B.

While expressions including ordinal numbers, such as "first" and "second", as used in various embodiments of the present invention may modify various constituent elements, such constituent elements are not limited by the above expressions. For example, the above expressions do not limit the sequence and/or importance of the elements. The above-described expressions may be used to distinguish an element from another element. For example, a first user device and a second user device indicate different user devices although both of them are user devices. For example, without departing from the scope of the present invention, a first component element may be named a second component element. Similarly, the second component element also may be named the first component element.

It should be noted that if it is described that one component element is "coupled" or "connected" to another component element, the first component element may be directly coupled or connected to the second component, and a third component element may be "coupled" or "connected" between the first and second component elements. Conversely, when one component element is "directly coupled" or "directly connected" to another component element, it may be construed that a third component element does not exist between the first component element and the second component element.

The terms as used in various embodiments of the present invention are merely for the purpose of describing particular embodiments and are not intended to limit the various embodiments of the present invention. As used herein, the singular forms are intended to include the plural forms as well, unless the context clearly indicates otherwise.

Unless defined otherwise, all terms used herein, including technical terms and scientific terms, have the same meaning as commonly understood by a person of ordinary skill in the art to which various embodiments of the present invention pertain. Such terms as those defined in a generally used dictionary are to be interpreted to have the meanings equal to the contextual meanings in the relevant field of art, and are not to be interpreted to have ideal or excessively formal meanings unless clearly defined in various embodiments of the present invention.

An electronic device according to various embodiments of the present invention may be a device including a communication function. For example, the electronic device may include at least one of a smart phone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (e.g., a head-mounted-device (HMD) such as electronic glasses, electronic clothes, an electronic bracelet, an electronic necklace, an electronic appcessory, an electronic tattoo, or a smart watch).

According to some embodiments, the electronic device may be a smart home appliance with a communication function. The smart home appliances may include at least one of, for example, televisions, digital video disk (DVD) players, audio players, refrigerators, air conditioners, cleaners, ovens, microwaves, washing machines, air purifiers, set-top boxes, TV boxes (e.g., HomeSync™ of Samsung, Apple TV™, or Google TV™), game consoles, electronic dictionaries, electronic keys, camcorders, or electronic frames.

According to some embodiments, the electronic device may include at least one of various medical appliances (e.g., magnetic resonance angiography (MRA), magnetic resonance imaging (MRI), computed tomography (CT), and ultrasonic machines), navigation equipment, a global positioning system (GPS) receiver, an event data recorder (EDR), a flight data recorder (FDR), automotive infotainment device, electronic equipment for ships (e.g., ship navigation equipment and a gyrocompass), avionics, security equipment, a vehicle head unit, an industrial or home robot, an automatic teller machine (ATM) of a banking system, and a point of sales (POS) of a shop.

According to some embodiments, the electronic device may include at least one of a part of furniture or a building/structure having a communication function, an electronic board, an electronic signature receiving device, a projector, and various kinds of measuring instruments (e.g., a water meter, an electric meter, a gas meter, a radio wave meter, and the like). The electronic device according to various embodiments of the present invention may be a combination of one or more of the aforementioned various devices. Further, the electronic device according to various embodiments of the present invention may be a flexible device. Further, it will be apparent to those skilled in the art that the electronic device according to various embodiments of the present invention is not limited to the aforementioned devices.

Hereinafter, an electronic device according to various embodiments of the present invention will be described with reference to the accompanying drawings. The term "user" as used in various embodiments of the present invention may indicate a person who uses an electronic device or a device (e.g., artificial intelligence electronic device) that uses an electronic device.

Hereinafter, a protection cover 200 according to various embodiments of the present invention will be described with reference to FIG. 1A to FIG. 20. Prior to description, FIG. 1A to FIG. 7 are diagrams illustrating a protection cover according to the first embodiment among various embodiments of the present invention, FIG. 8 to FIG. 15 are diagrams illustrating a protection cover according to the second embodiment among various embodiments of the present invention, and FIG. 16 to FIG. 20 are diagrams illustrating a protection cover according to the third embodiment among various embodiments of the present invention.

A protection cover 200 according to various embodiments of the present invention may be provided as a separate component that covers a body portion 100 of an electronic device, or may be configured to cover the electronic device and provided as a component of the electronic device. For example, a rear case is provided on the back surface of the body portion 100 of the electronic device such that a battery is mounted thereon so as to supply the electronic device with power.

For example, when the protection cover 200 is provided as a separate component that covers the electronic device, a back case 120 is provided on the back surface of the body portion 100 so as to cover the rear case, and the protection cover 200 is provided with the back case 120.

For example, furthermore, when the protection cover 200 is provided as a component of the electronic device, the protection cover 200 is coupled to the body portion 100 so as to cover the rear case, which is provided on the back surface of the body portion 100, such that the protection cover 200 has the function of the above-mentioned back case 120.

It will be assumed, for example, that the protection cover 200 according to the first embodiment among various embodiments of the present invention is configured as a component of the electronic device. Specifically, the protection cover 200 has a back cover 230 provided to cover the rear case of the body portion 100 of the electronic device; the protection cover 200 is coupled to the body portion 100 so as to cover the body portion 100, and the back cover 230 of the protection cover 200 is provided to have a function corresponding to that of the back case 120 of the electronic device. Although it is assumed for example that the protection cover 200 according to the first embodiment among the present invention is a component of the electronic device, this assumption is not limiting in any manner. Any change or modification could be made, as in the case of the second or third embodiment described later, for example, such that the same is a component provided separately from the electronic device.

In addition, it will be assumed for example that the protection cover 200 according to the second and third embodiments among various embodiments of the present invention is provided as a component separate from the electronic device. Specifically, the electronic device has a back case 120 provided to cover the rear case of the body portion 100, and the protection cover 200 is provided to cover the body portion 100, which has the back case 120. Although it is assumed for example that the protection cover 200 according to the second and third embodiments of the present invention is a component separate from the electronic device, this assumption is not limiting in any manner. Any change or modification could be made, as in the case of the above-mentioned first embodiment, for example, such that the same is a component integrated with the electronic device.

Firstly, a protection cover 200 according to the first embodiment among various embodiments of the present invention will be described with reference to FIG. 1 to FIG. 7.

Figure 1B:
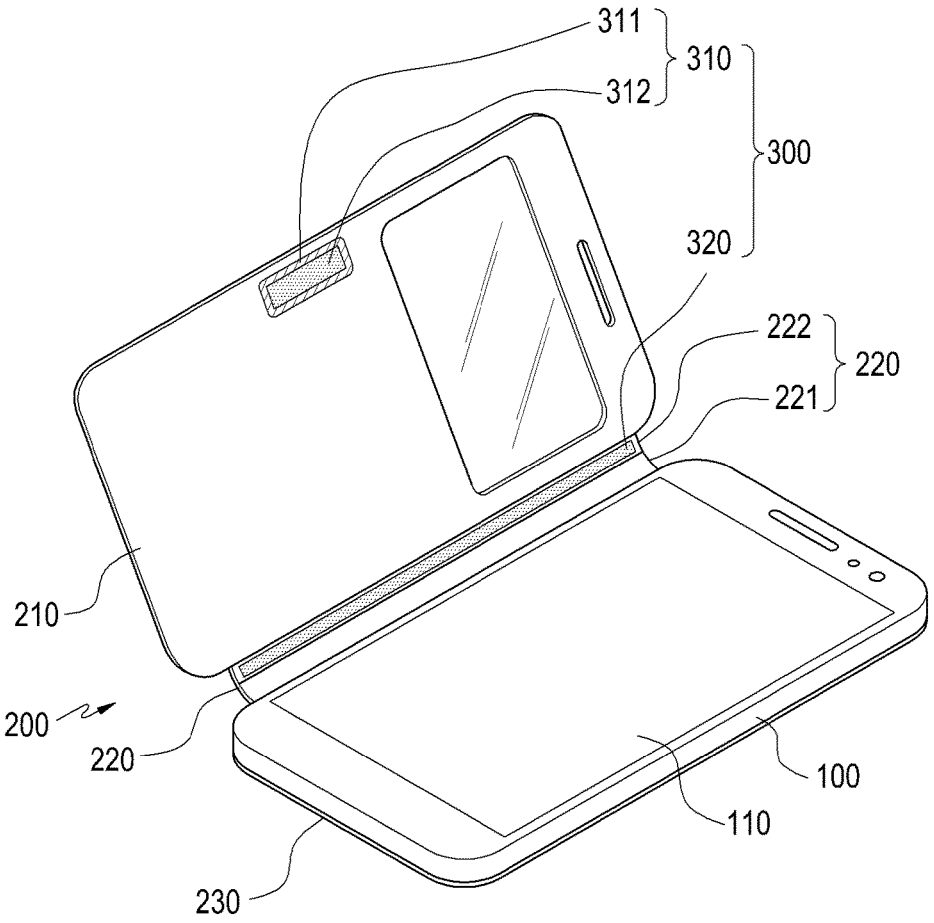
Figure 2:
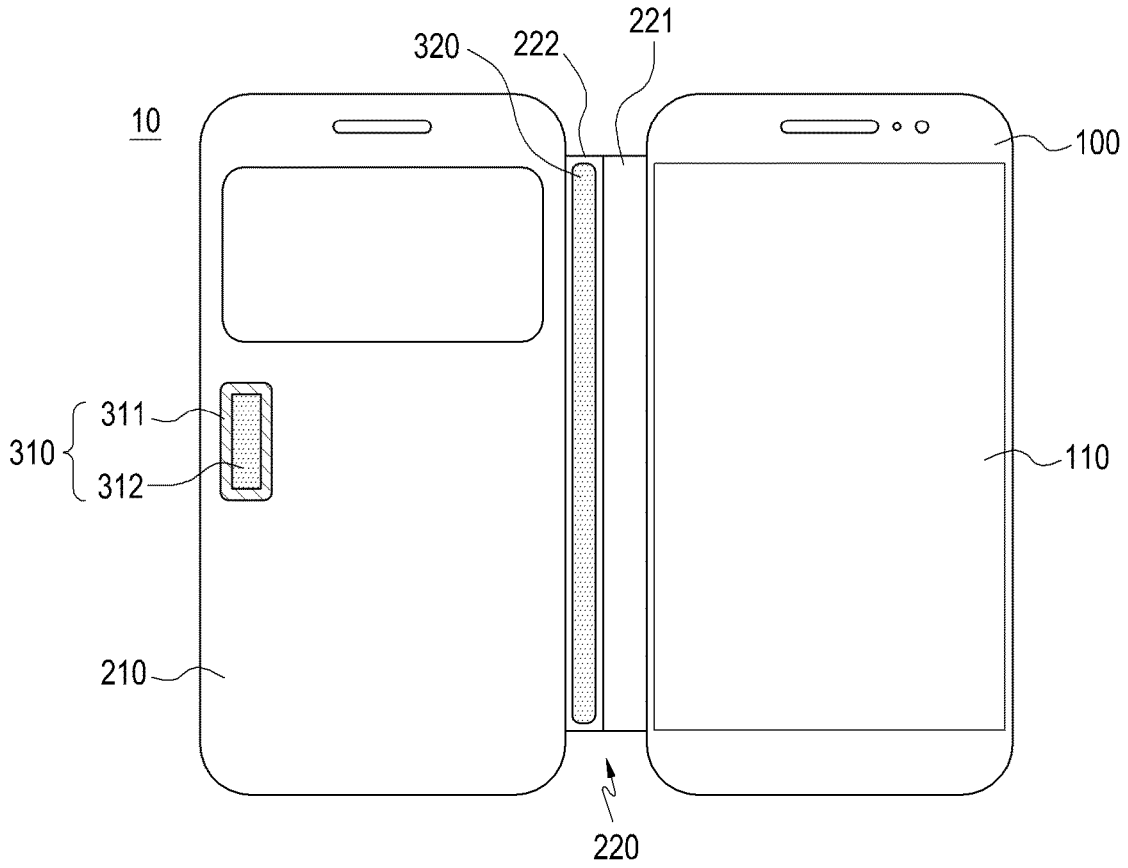
FIG. 2 is a top view of an electronic device having a protection cover according to the first embodiment among various embodiments of the present invention.
Figure 3:
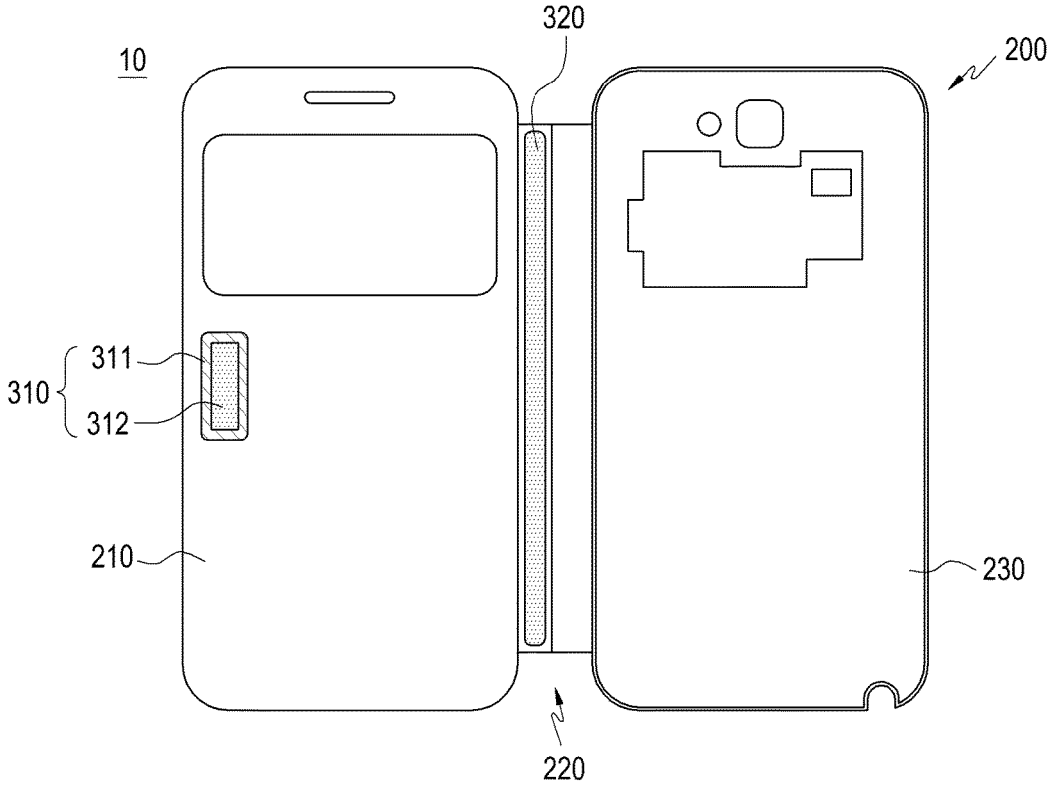
FIG. 3 is a diagram illustrating an electronic device having a protection cover according to the first embodiment among various embodiments of the present invention.

FIGS. 1A and 1B are perspective views of an electronic device having a protection cover according to the first embodiment among various embodiments of the present invention. FIG. 2 is a top view of an electronic device having a protection cover according to the first embodiment among various embodiments of the present invention. FIG. 3 is a diagram illustrating a protection cover 200 according to the first embodiment among various embodiments of the present invention.

Referring to FIG. 1A to FIG. 3, the protection cover 200 according to the first embodiment among various embodiments of the present invention may both cover the electronic device, as described above, and have the function of the back case 120 of the body portion 100 of the electronic device.

The protection cover 200, which is provided on an electronic device according to various embodiments of the present invention, will herein be described. Firstly, examples of application of the electronic device according to embodiments of the present invention may include, as described above, not only all mobile communication terminals that operate on the basis of communication protocols, which correspond to various communication systems, but also all kinds of information communication devices, multimedia devices, and applied devices related thereto, such as a PMP (portable multimedia player), an MP3 player, a navigation device, a game console, a laptop computer, a netbook, an advertisement board, a TV set, a digital broadcast player, a PDA (personal digital assistant), a smartphone, a tablet PC, a Galaxy Tab, and an iPad. It will be assumed for example that the electronic device, to which the protection cover 200 according to various embodiments of the present invention is coupled, is formed in a bar type. However, the type of the electronic device is not limited thereto, and the type, configuration, or structure of the electronic device may be changed or modified, as need, as long as the device requires a protection cover 200.

The electronic device according to various embodiments of the present invention may include a display portion 110 and a body portion 100, which includes a rear case that has a battery mounting space, on the front and back surfaces thereof, respectively. The display portion 110 may be made of one selected from a touch screen panel, an LCD, and a flexible display. It will be assumed for example that the display portion 110 is made of a touch screen panel, an LCD, or a flexible display, but the assumption is not limited in any manner. Any type of display portion 110 may be employed as long as the display portion 110 enables moving picture watching and touch input. It will be assumed in following description of various embodiments of the present invention that a touch screen panel is used as an example of the display portion 110 of the electronic device.

The protection cover 200 according to the first embodiment among various embodiments of the present invention may include a cover portion 210, 220, and 230 and an adsorption portion 300.

The cover portion 210, 220, and 230 may be provided to be directly covered on a rear case, which is provided on the back surface of the body portion 100 of the electronic device. The cover portion 210, 220, and 230 according to the first embodiment of the present invention is a component that has a flip cover shape. The cover portion 210, 220, and 230 may include a back cover 230, a front cover 210, and a connection member 220. The cover portion 210, 220, and 230 according to the first embodiment of the present invention is a component, which covers the electronic device, and which makes it possible to cradle the electronic device on a vertical surface 20 such as a wall surface; furthermore, when folded on the display portion 110 of the body portion 100, the cover portion 210, 220, and 230 can remain folded on the display portion 110 while covering the display portion 110.

The front cover 210 is positioned on the front surface of the electronic device so as to protect the front surface of the body portion 100 of the electronic device, particularly the display portion 110, and so as to expose/cover the display portion 110. The front cover 210 is rotatably provided on the back cover 230, and may be rotatably connected to the back cover 230 via the connection member 220. The front cover 210 is folded on the front surface of the display portion 110, and can be rotated by the connection member 220, in order to use the display portion 110, and folded on the back surface of the body portion 100 of the electronic device, particularly on the back cover 230. A first adsorption portion 310 (described later) may be provided on the inner surface of the front cover 210, particularly in a predetermined position on the other end that faces one end, which is connected to the connection member 220. The inner surface of the front cover 210 may be made of a material, such as cloth, such that, when the same engages with the display portion 110, any damage to the display portion 110 is prevented; alternately, the inner surface may be formed using a material such as compressed paper or compressed cloth. The inner surface is mounted on the back surface of the electronic device so as to support opening/closing of the front cover 210.

The back cover 230, as described above, may be provided as a component of the electronic device so as to cover the back surface of the body portion 100, particularly the rear case of the body portion 100. The front cover 210 is rotatably connected to one side of the back cover 230 by the connection member 220. The back cover 230 may be made of a plastic material so as to cover the rear case and to be coupled to the back surface of the body portion 100, and may further include a material, such as silicone or rubber, in a bumper type so as to attenuate impacts resulting from drops and the like. As described above, the back cover 230 may be largely provided in one of two types. Specifically, as in the first embodiment of the present invention, the back cover 230 is provided either integrally with the body portion 100 or separately from the body portion 100. As in the first embodiment of the present invention, the back cover 230, which is provided integrally with the body portion 100, is configured to cover a rear case that has a battery mounting space so as to cover a battery, which is mounted on the back surface of the body portion 100. In addition, the back cover 230, which is provided separately from the body portion 100, is provided separately from the body portion 100 so as to separately cover the back surface of the body portion 100 while a back case 120 (also referred to as a battery cover) is provided on the back surface of the body portion 100. It will be assumed, for example, in the description of the first embodiment of the present invention that the back cover 230 is integrally coupled to the body portion 100 on the back surface of the body portion 100. However, the configuration, structure, type, or the like of the back cover 230 may be changed or modified as long as the same is provided separately to cover the back surface of the body portion 100.

The connection member 220 is a component provided on one side of the back cover 230 and configured to rotatably connect the front cover 210 to one side of the back cover 230. The connection member 220 according to the first embodiment of the present invention may be provided to have two split surfaces 221 and 222. The first split surface 221 may be connected to the back cover 230 and provided to surround one side surface of the body portion 100 of the electronic device. The first split surface 221 is also configured such that, when the front cover 210 folded on the display portion 110 is rotated approximately 360° and then folded on the back cover 230, the front cover 210 can rotate with regard to the back cover 230. The second split surface 222 is a component connected to the first split surface 221 and coupled to the front cover 210. The second split surface 222 has a second adsorption portion 320 and 330 (described later) provided such that, when the front cover 210 rotates with regard to the back cover 230 and faces the same, the protection cover 200, which is provided with the electronic device, can be adsorbed on a vertical surface 20. The second split surface 222 is provided such that, when the front cover 210 is rotated to face the back cover 230, the second split surface 222 can form the same surface with the inner surface of the front cover 210; accordingly, the second split surface 222 can be further rotated, bent, or elastically moved about a shaft of connection with the first split surface 221 such that the same moves to the back surface of the first split surface 221. When the front cover 210 is rotated and folded on the back cover 230, the second split surface 222 can form the same surface with the inner surface of the front cover 210; accordingly, the second adsorption portion 320 and 300, which is mounted on the second split surface 222, enables adsorption on a vertical surface 20 such as a wall surface.

Figure 4:
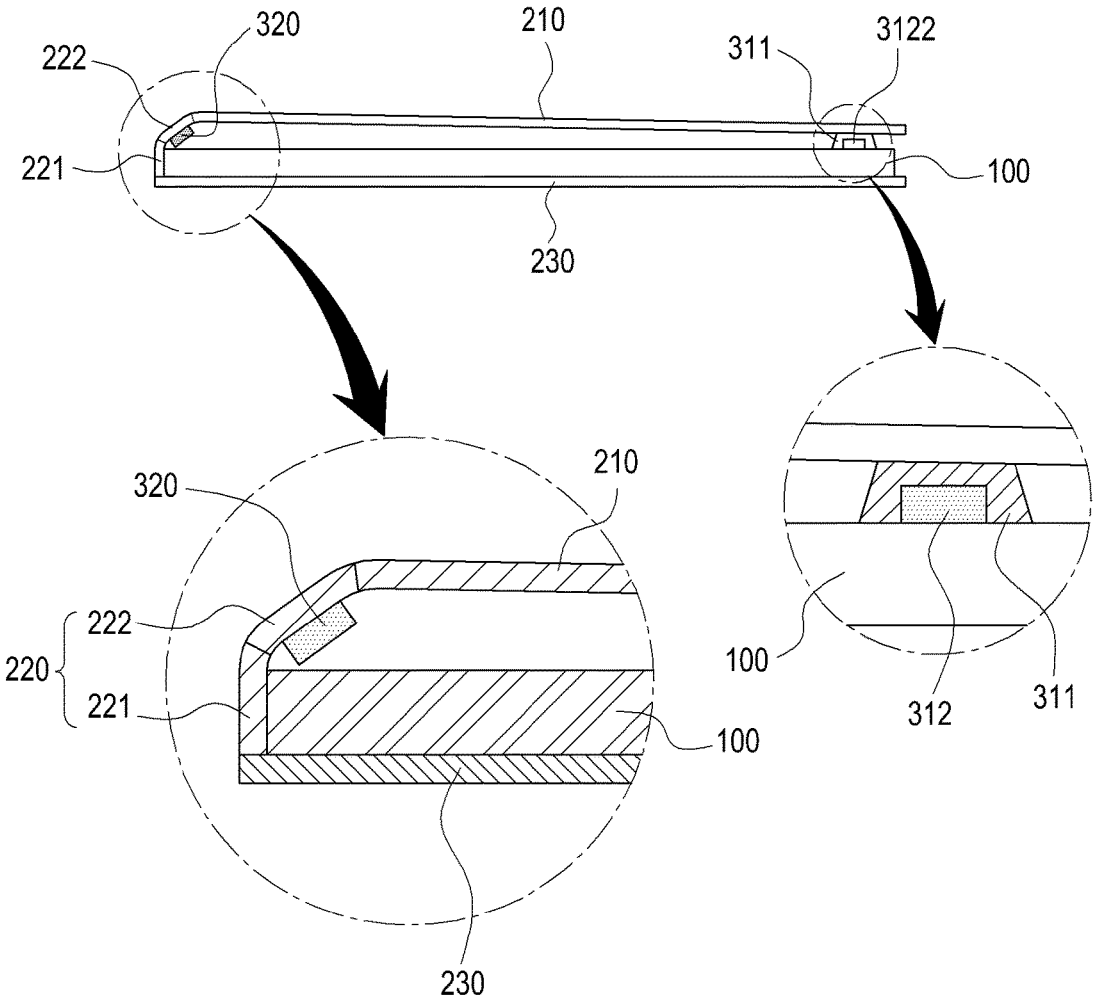
FIG. 4 is a sectional view of an electronic device having a protection cover according to the first embodiment among various embodiments of the present invention.
Figure 5:
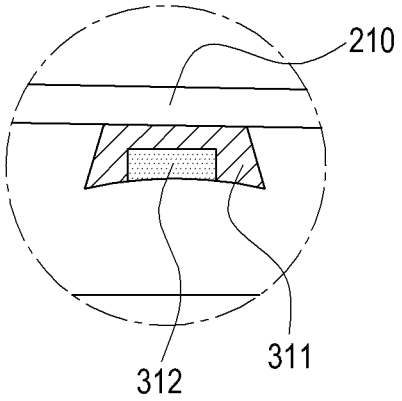
FIG. 5 is a diagram illustrating a first adsorption portion in connection with an electronic device having a protection cover according to the first embodiment among various embodiments of the present invention.

FIG. 4 is a sectional view of an electronic device having a protection cover according to the first embodiment among various embodiments of the present invention. FIG. 5 is a diagram illustrating a first adsorption portion in connection with an electronic device having a protection cover according to the first embodiment among various embodiments of the present invention.

Referring to FIG. 4 and FIG. 5, the adsorption portion 300 is a component provided on the cover portion 210, 220, and 230 such that, while the electronic device is mounted, the cover portion 210, 220, and 230 can be adsorbed and retained on a vertical surface 20, and the adsorption portion 300 is also configured such that the front cover 210 can be retained on the display portion 110. Particularly, the adsorption portion 300 may be provided on the front cover 210 and the connection member 220, among the cover portion 210, 220, and 230.

The adsorption portion 300 may include a first adsorption portion 310 and a second adsorption portion 320 and 300.

The first adsorption portion 310 may be provided on the inner surface of the front cover 210, particularly near the other end that faces one end, at which the front cover 210 is connected to the connection member 220. The first adsorption portion 310 may largely have two functions. Firstly, the first adsorption portion 310 may be provided to retain the front cover 210 on the display portion 110 according to the folding position of the front cover 210; secondly, the first adsorption portion 310 may be provided so as to make the cover portion 210, 220, and 230 retained on a vertical surface 20, such as a wall surface, together with the second adsorption portion 320 and 300. When the front cover 210 is positioned while being folded on the display portion 110, the first adsorption portion 310 may be adsorbed on a surface of the display portion 110 of the body portion 100 of the electronic device such that the front cover 210 is retained on the display portion 110. As the front cover 210 is adsorbed on the surface of the display portion 110, the front cover 210 is prevented from moving or playing.

The first adsorption portion 310 may include a first adsorption plate 311 and a second adsorption plate 312.

The first adsorption plate 311 may have a curvature surface such that a surface thereof is retained on the inner surface of the front cover 210, while another surface thereof can be adsorbed on a surface of the display portion 110 or on a surface of a vertical surface 20. The first adsorption plate 311 may have an opening 311*a* formed thereon such that a second adsorption plate 312 (described later) can be provided therein. It will be assumed for example that the opening 311*a* according to the first embodiment is positioned at the center part of the first adsorption plate 311. This may provide such a shape that, about the second adsorption plate 312, the first adsorption plate 311 is provided around the periphery of the second adsorption plate 312. The surface of the first adsorption plate 311 may have a radius of curvature such that the surface is recessed inwards as the same comes closer to the second adsorption plate 312. As will be described later, the surface of the second adsorption plate 312 may have such a radius of curvature that the radius of curvature of the surface of the first adsorption plate 311 is connected thereto. The first adsorption plate 311 may include a compression member made of a rubber material, such as silicone, for example. The first adsorption plate 311 may also be configured as a sucker, for example.

The second adsorption plate 312 is mounted in the opening 312*a*. The surface of the second adsorption plate 312 is formed to have such a radius of curvature that the same can be adsorbed on the surface of the display portion 110, and the second adsorption plate 312 may have a radius of curvature that is continuous with that of the surface of the first adsorption plate 311. The second adsorption plate 312 may be provided to have an adsorbing force that is higher than that of the first adsorption plate 311. The second adsorption plate 312 may have an adsorbing force, which gradually increases from an end of the front cover 210 towards the connection member 220, such that, when the front cover 210 is folded on the display portion 110, when the first adsorption plate 311 and the second adsorption plate 312 are adsorbed on the surface of the display portion 110, and when the front cover 210 is to be released from the display portion 110, the second adsorption plate 312 can be easily released. That is, with reference to FIG. 4, the second adsorption plate 312 may be provided to have an adsorbing force that increases from the left side to the right side. Accordingly, when the first adsorption plate 311 and the second adsorption plate 312 that are adsorbed on the surface of the display portion 110 are to be released from the surface of the display portion 110, they can be easily separated along the direction of release of the front cover 210. The second adsorption plate 312 may be provided using a material different from that of the first adsorption plate 311; and the second adsorption plate 312 may be made of a material including nano suction gel.

In a normal situation when the front cover 210 does not need to be firmly retained on the display portion 110, the first adsorption plate 311 is adsorbed on the surface of the display portion 110, while the second adsorption plate 312 does not face the surface of the display portion 110. Therefore, the front cover 210 can be moved away from the display portion 110 simply by releasing the first adsorption plate 311. However, when more retaining force is needed (for example, when carried), the first adsorption plate 311 and the second adsorption plate 312 may both be adsorbed on the surface of the display portion 110, thereby retaining the front cover 210 on the display portion 110 more firmly.

Furthermore, the surface of the first adsorption portion 310, which includes the first adsorption plate 311 and the second adsorption plate 312, is formed to have a predetermined radius of curvature such that, when the first adsorption portion 310 is adsorbed on the surface of the display portion 110, air on the radius of curvature is discharged, making it possible to make the same adsorbed on the surface of the display portion 110, and the second adsorption plate 312 enhances the adsorbing force with regard to the surface of the display portion 110.

In addition, when the first adsorption portion 310 is adsorbed on the surface of the display portion 110, the user can introduce air between the surface of the display portion 110 and the first adsorption portion 310 using a fingernail, for example, thereby releasing the display portion 110 that has been adsorbed. In this case, the first adsorption plate 311 can be instantly released from the surface of the display portion 110 simply by introducing air; in the case of the second adsorption plate 312, however, the user needs to apply a predetermined force, besides introducing air, from one side of the display portion 110 towards the connection member 220 such that a release occurs from one side of the second adsorption plate 312, which has the strongest adsorbing force, towards the connection member 220.

The second adsorption portion 320 and 300 may have a thickness smaller than or equal to that of the first adsorption portion 310. This guarantees that, when the front cover 210 is folded on the back cover 230 and then is adsorbed and retained on a vertical surface 20, the electronic device can remain almost parallel with the vertical surface 20.

The thicknesses of the first adsorption portion 310 and of the second adsorption portion 320 and 300 ensure that, when the front cover 210 is positioned on the front surface of the display portion 110, the front cover 210 and the display portion 110 are spaced from each other by a predetermined interval. Particularly, when the front cover 210 is adsorbed on the display portion 110 while the protection cover 200 covers the body portion 100 of the electronic device, a space having a predetermined interval (hereinafter, referred to as a "first interval") may be generated between the display portion 110 and the front cover 210, depending on the thickness of the first adsorption portion 310. In addition, the first split surface 221 is formed to have a thickness enough to cover the thickness of the side surface of the body portion 100; the second split surface 222 extends from the first split surface 221 and has a second adsorption portion 320 and 300 formed thereon such that, due to the thickness of the second adsorption portion 320 and 300, the same is spaced from the upper side of the display portion 110 of the body portion 100 by a predetermined interval, thereby generating a space (hereinafter, referred to as a "second interval"). Therefore, the front cover 210 is positioned to be spaced from the surface of the body portion 100 by a predetermined interval. In this case, the first interval near one side of the front cover 210 and the second interval near the other side thereof may be formed to be identical; alternatively, the second interval may be formed to be larger than the first interval.

Figure 6:
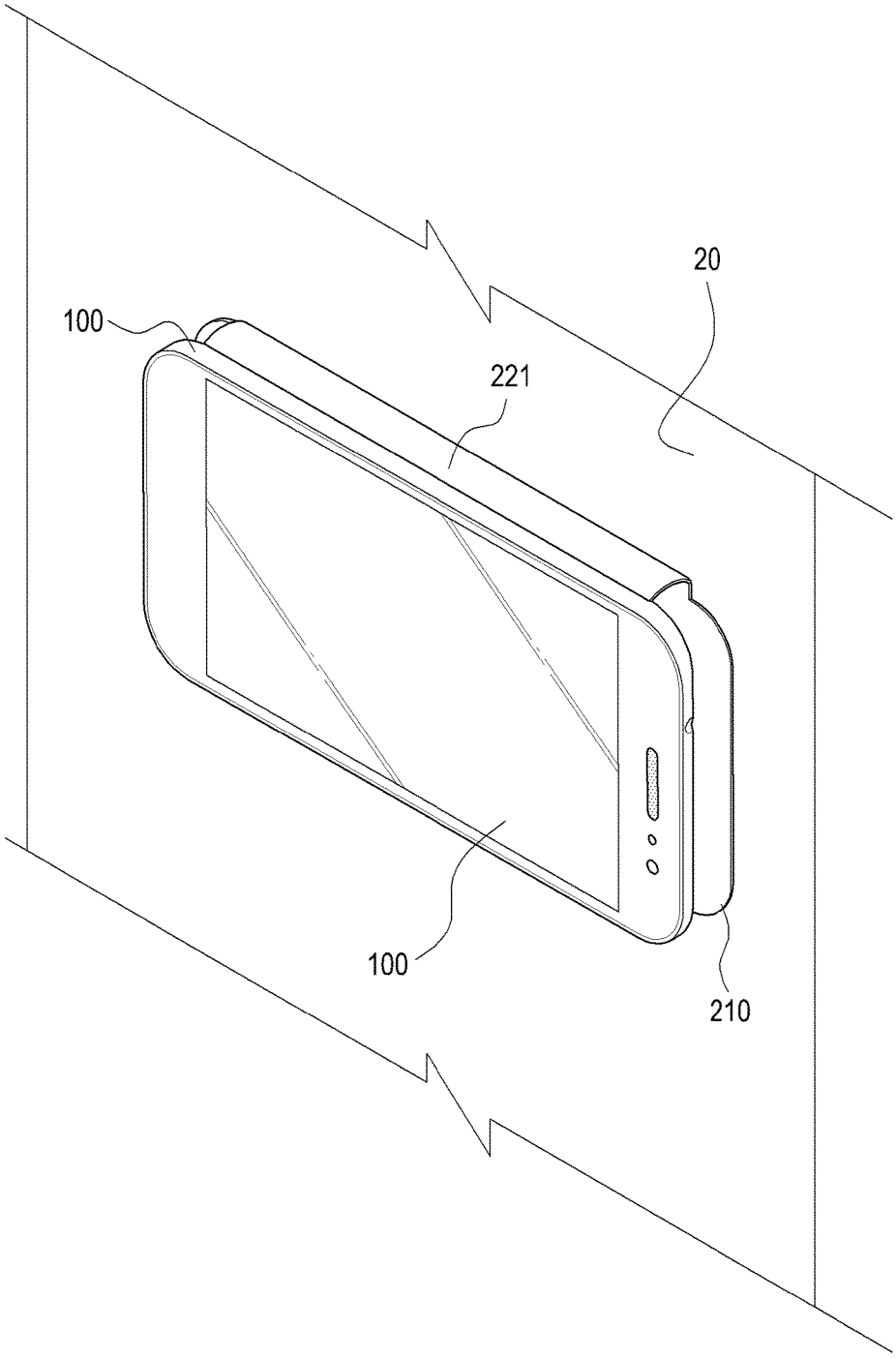
FIG. 6 is a perspective view illustrating an electronic device having a protection cover according to the first embodiment among various embodiments of the present invention, the electronic device being cradled on a vertical surface.
Figure 7:
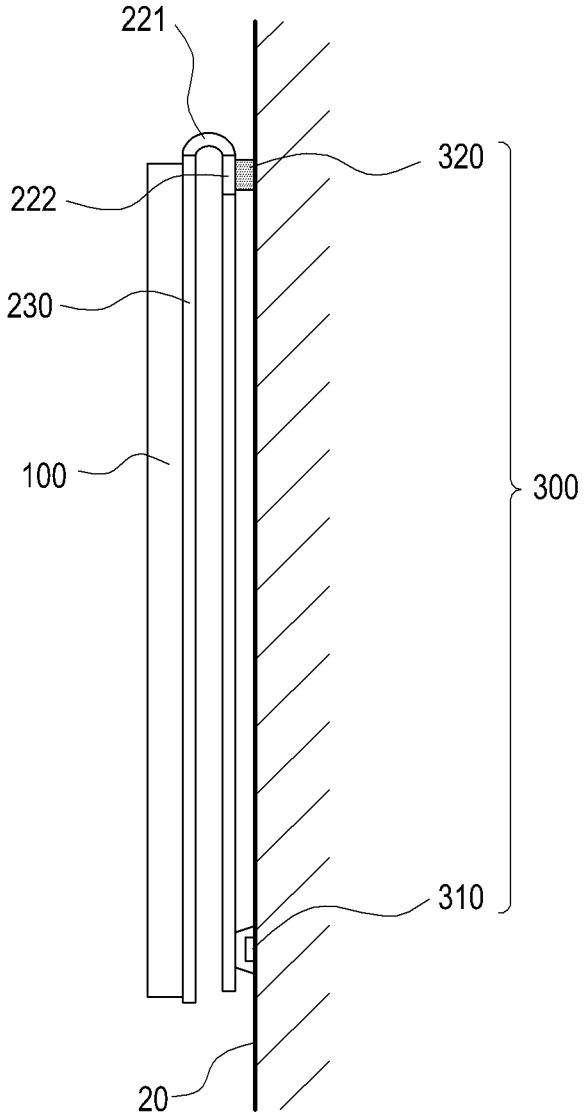
FIG. 7 is a sectional view illustrating an electronic device having a protection cover according to the first embodiment among various embodiments of the present invention, the electronic device being cradled on a vertical surface.

FIG. 6 is a perspective view illustrating an electronic device having a protection cover according to the first embodiment among various embodiments of the present invention, the electronic device being cradled on a vertical surface. FIG. 7 is a sectional view illustrating an electronic device having a protection cover according to the first embodiment among various embodiments of the present invention, the electronic device being cradled on a vertical surface.

Referring to FIG. 6 and FIG. 7, the electronic device having a protection cover 200 provided as in the first embodiment of the present invention is configured such that, when carried, the first adsorption portion 310 can be adsorbed on the surface of the display portion 110 and maintain the front cover 210 in the retained state, and, when the user wants to use the multimedia function using the electronic device, the electronic device can be retained on a vertical surface 20.

For example, when the user wants to watch a moving picture during a long train trip, the user rotates the front cover 210 and folds it on the back cover 230. Accordingly, the first adsorption portion 310 and the second adsorption portion 320 and 300 are positioned on the back surface of the electronic device and can be exposed to the outside. The electronic device is attached to the back surface of the front seat such that the second adsorption portion 320 and 300 is positioned on the upper portion of the vertical surface 20, while the first adsorption portion 310 is positioned on the lower portion of the wall surface, with regard to the second adsorption portion 320 and 300. When the front cover 210 is forced against the vertical surface 20 of the front seat, the second adsorption portion 320 and 300 is adsorbed and retained on the vertical surface 20, due to the adsorbing force thereof, and the first adsorption portion 310 can be adsorbed and retained on the vertical surface 20 by means of the first adsorption plate 311 and the second adsorption plate 312. In this state, the electronic device can be adsorbed, retained, and cradled on the vertical surface 20 of the front seat. The user then can watch moving pictures freely using both hands.

Hereinafter, a protection cover 200 according to the second embodiment among various embodiments of the present invention will be described with reference to FIG. 8 to FIG. 15. It is to be noted, prior to description of the protection cover 200 according to the second embodiment of the present invention, that repeated description of the same configuration or structure as that of the electronic device having the protection cover 200 according to the first embodiment, described above, will be omitted herein for clarity of description. The protection cover 200 according to the second embodiment of the present invention is different from the above-described first embodiment in that no front cover 210 is provided, the back surface of the body portion 100 cover the electronic device, on which a back case 120 is mounted, and the structure of the back cover 230 and the position of the adsorption portion 300 are different. The differences will now be described in detail.

Figure 8:
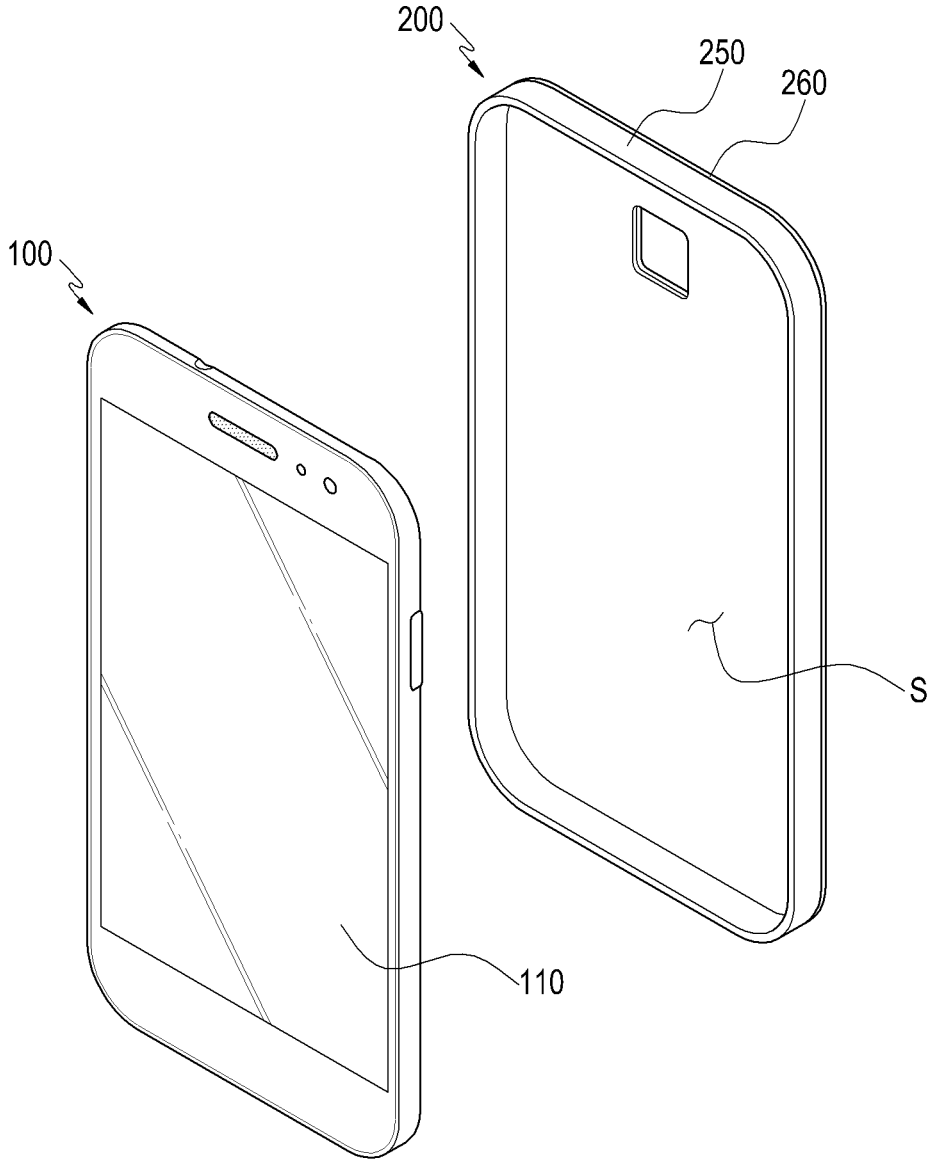
FIG. 8 is an exploded perspective view of an electronic device having a protection cover according to the second embodiment among various embodiments of the present invention, viewed from the front.
Figure 9:
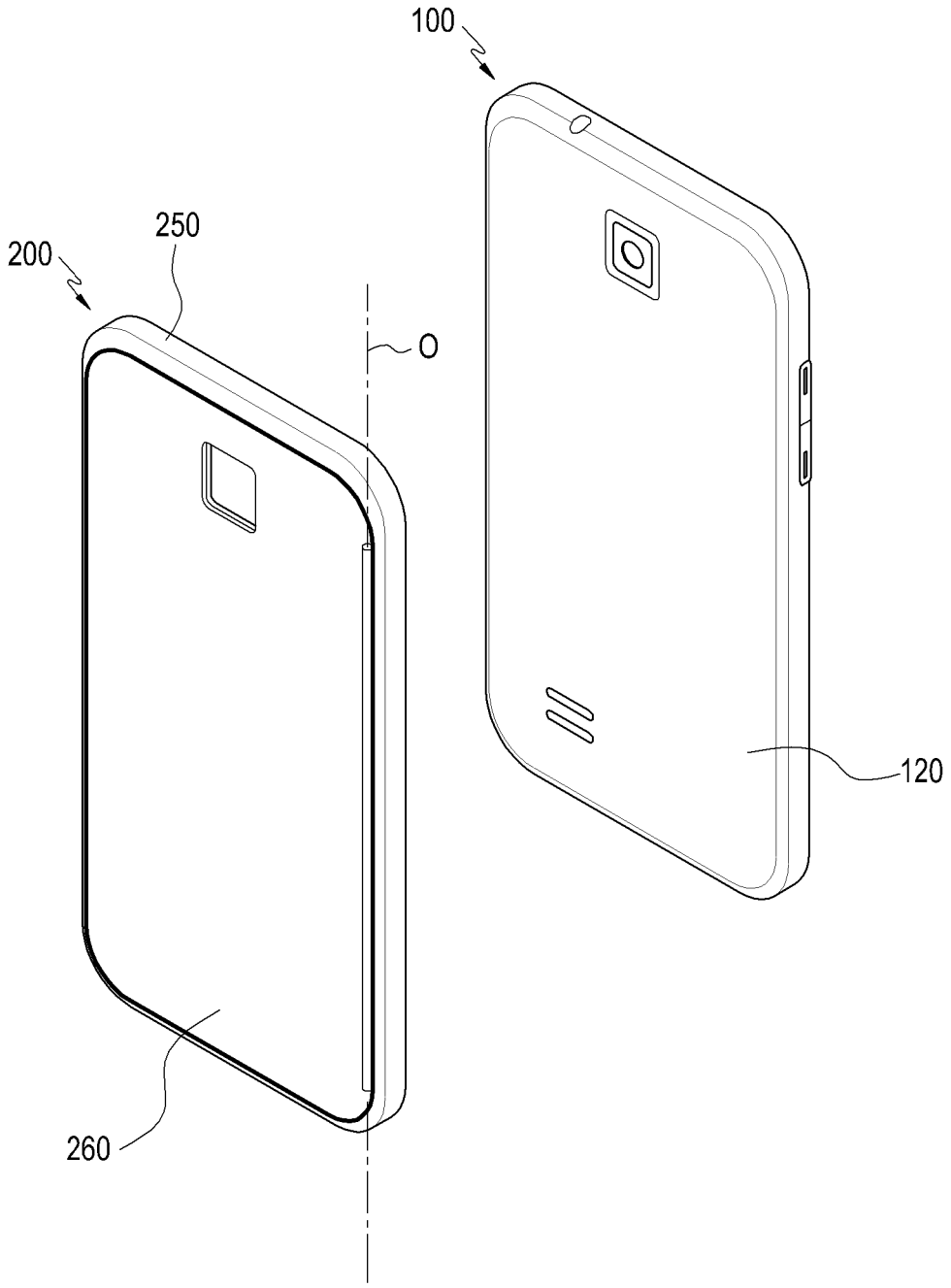
FIG. 9 is an exploded perspective view of an electronic device having a protection cover according to the second embodiment among various embodiments of the present invention, viewed from the rear.

FIG. 8 is an exploded perspective view of an electronic device having a protection cover according to the second embodiment among various embodiments of the present invention, viewed from the front. FIG. 9 is an exploded perspective view of an electronic device having a protection cover according to the second embodiment among various embodiments of the present invention, viewed from the rear.

Referring to FIG. 8 and FIG. 9, the protection cover 200 according to the second embodiment among various embodiments of the present invention may include a cover portion 250 and 260 and an adsorption portion 300 (see FIG. 10 to FIG. 13). The cover portion 250 and 260 according to the second embodiment is, unlike the flip cover according to the first embodiment, constitutes a cover configured to surround and cover only the edge of the exterior of the electronic device or the back surface thereof. It will be assumed for example that the cover portion 250 and 260 according to the second embodiment of the present invention is a component provided separately from the electronic device; specifically, the electronic device includes a body portion 100 and a back case 120, which covers a rear case on the back surface of the body portion 100, and the cover portion 250 and 260 is provided on the electronic device so as to protect the electronic device, which includes the back case 120. However, the cover portion 250 and 260 is not necessarily a component provided separately from the electronic device, as described above, and the cover portion 210, 220, and 230 may be configured as a component of the electronic device. For example, the rear case of the body portion 100 is provided with no separate back case 120, and the cover portion 250 and 260 according to the second embodiment of the present invention is provided to incorporate the function of the back case 120. Therefore, any change or modification is possible in connection with whether the cover portion 250 and 260 is provided as a component of the electronic device or provided as a component that is separate from the electronic device.

The cover portion 250 and 260 according to the second embodiment of the present invention may include a back housing 250 and a surface cover 260.

The back housing 250 forms a space, in which the body portion 100 of the electronic device is mounted, and covers a back case 120, which covers the peripheral surface of the body portion 100 of the electronic device and the rear case on the back surface of the body portion 100. The surface of the back housing 250 is provided to be exposed to the outside, and the surface may be provided to be exposed/covered by the surface cover (described later).

The surface cover 260 is positioned on the surface of the back housing 250 so as to cover the surface of the back housing 250, and may be rotatably provided on one side of the back housing 250. The surface cover 260 can be rotated away from the back housing 250 about a rotation shaft O, which is provide on one side of the surface cover 250, and, when rotated, exposes the surface of the back housing 250 to the outside. The surface cover 260 may be made of a hard material, such as plastic, or may be made of a flexible material such that the same can change the shape. That is, the material of the surface cover 260 according to the second embodiment of the present invention can be changed or modified in any manner as long as the surface cover 260 can cover the surface of the back housing 250 and can expose the surface of the back housing 250 when rotated.

Furthermore, although it has been assumed for example that the surface cover 260 according to the second embodiment is configured to expose the surface of the back housing 250 when rotated away from the back housing 250, this assumption is not limiting in any manner. The driving, structure, or shape of the surface cover 260 could be changed or modified such that, for example, the surface cover 260 can slide on the back housing 250, or the surface cover 260 can fully escape from the back housing 250, as long as the same can expose the surface of the back housing 250 to the outside.

Figure 10:
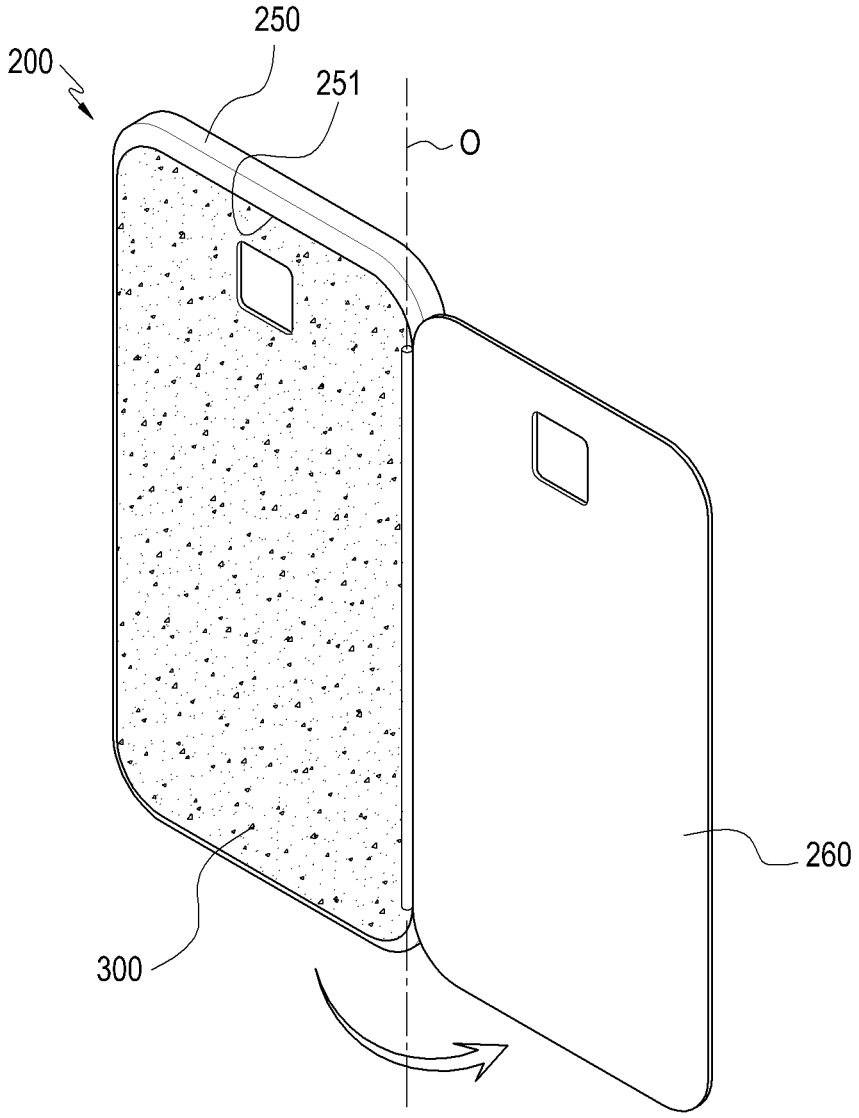
FIG. 10 is a diagram illustrating an embodiment of an adsorption portion in connection with a protection cover according to the second embodiment among various embodiments of the present invention.
Figure 11:
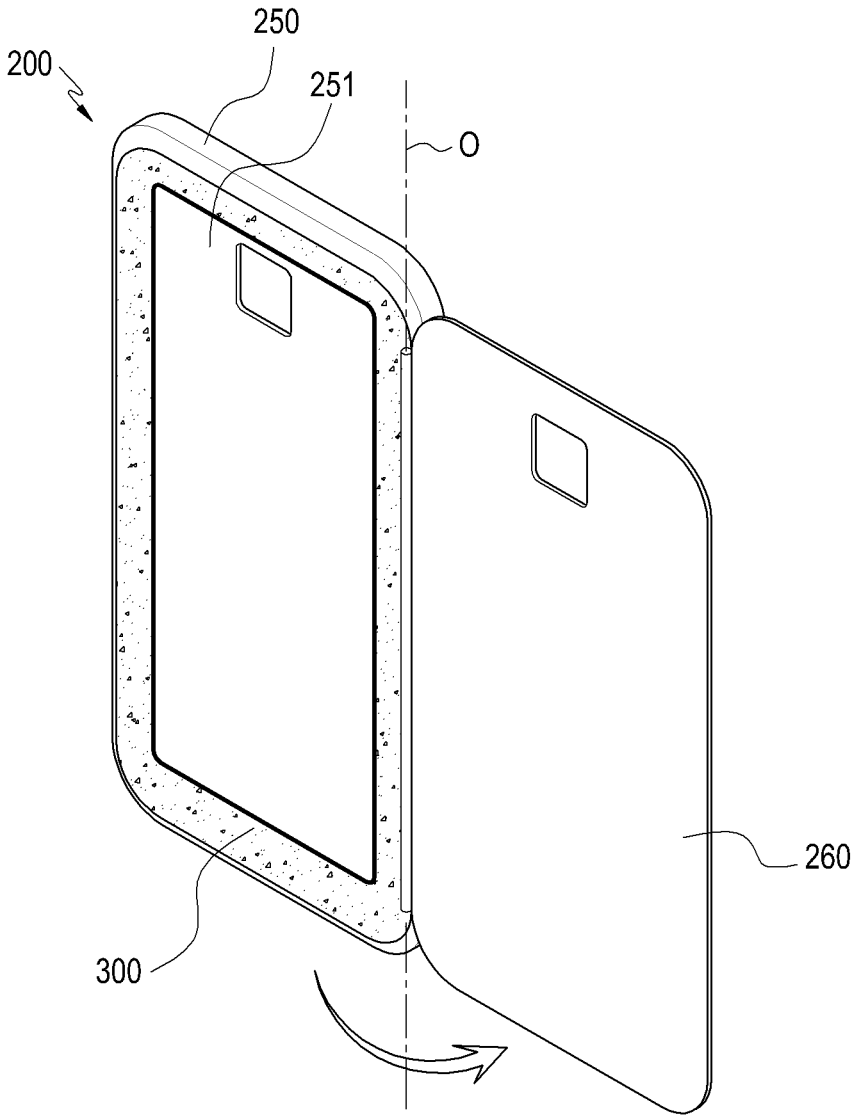
FIG. 11 is a diagram illustrating another embodiment of the adsorption portion in connection with a protection cover according to the second embodiment among various embodiments of the present invention.
Figure 12:
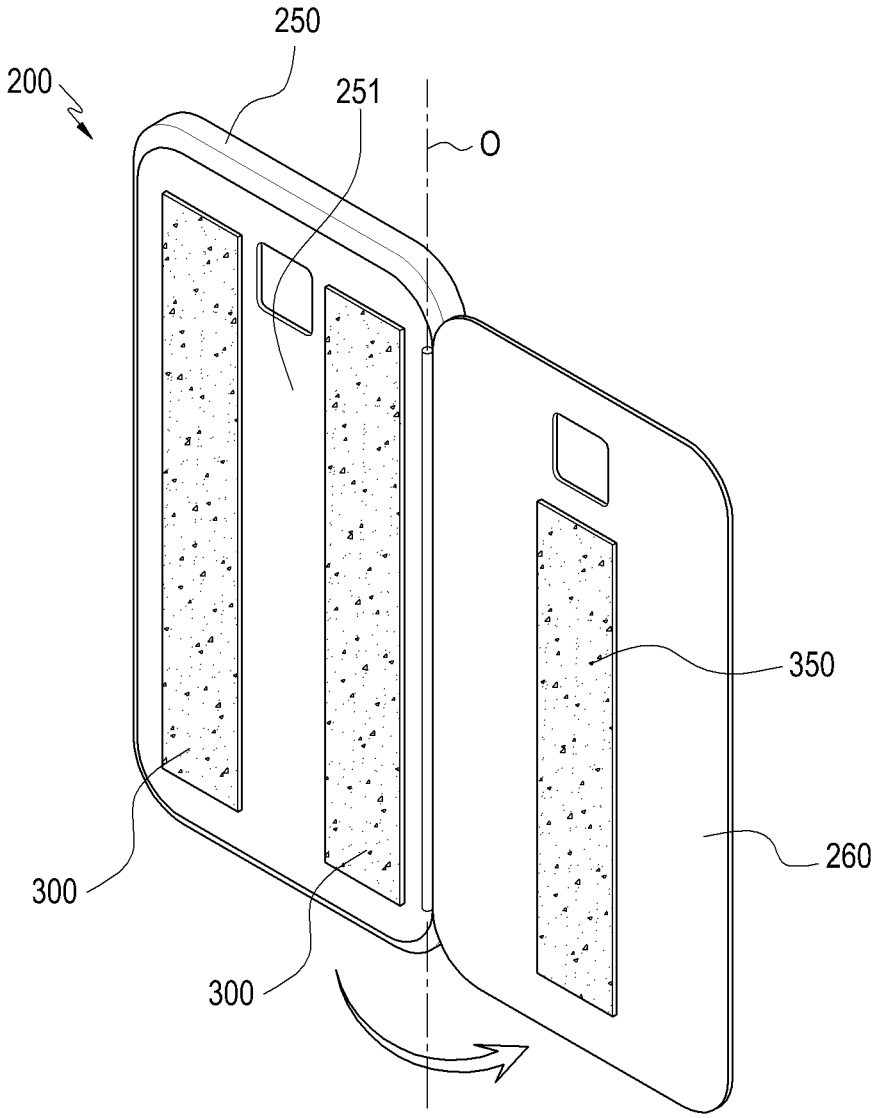
FIG. 12 is a diagram illustrating still another embodiment of the adsorption portion in connection with a protection cover according to the second embodiment among various embodiments of the present invention.
Figure 13:
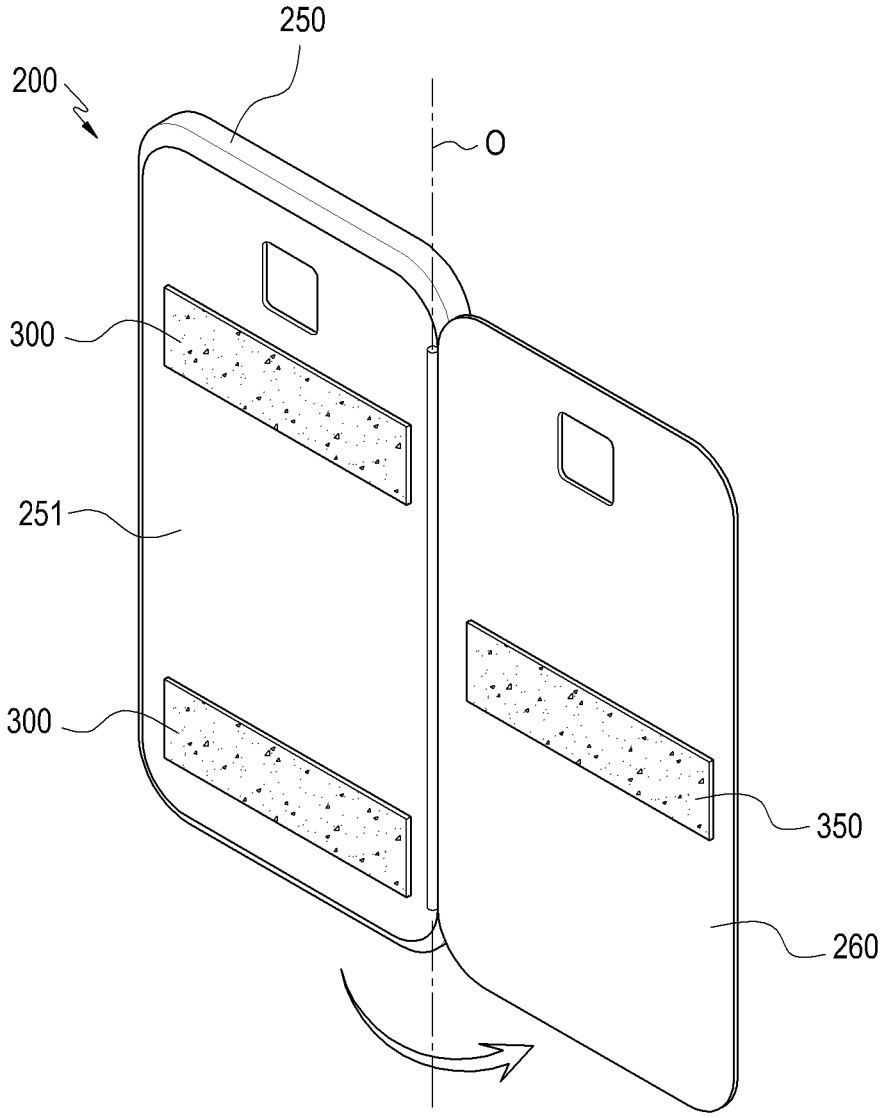
FIG. 13 is a diagram illustrating still another embodiment of the adsorption portion in connection with a protection cover according to the second embodiment among various embodiments of the present invention.

FIG. 10 is a diagram illustrating an embodiment of an adsorption portion in connection with a protection cover according to the second embodiment among various embodiments of the present invention. FIG. 11 is a diagram illustrating another embodiment of the adsorption portion in connection with a protection cover according to the second embodiment among various embodiments of the present invention. FIG. 12 is a diagram illustrating still another embodiment of the adsorption portion in connection with a protection cover according to the second embodiment among various embodiments of the present invention. FIG. 13 is a diagram illustrating still another embodiment of the adsorption portion in connection with a protection cover according to the second embodiment among various embodiments of the present invention.

Referring to FIG. 10 to FIG. 13, the adsorption portion 300 is provided on the surface of the back housing 250 so as to be exposed to the outside as the surface cover 260 is opened/closed. The adsorption portion 300 according to the second embodiment of the present invention may include a nano suction gel material. Although not illustrated, the adsorption portion 300 may include a plate, which is coupled to the surface of the back housing 250, a plurality of semi-circular protrusions, which are provided on the plate, and which has elasticity, and nano suction gel provided on the surface of the protrusions in dot shapes. Accordingly, the nano suction gel, which is formed on the protrusions in dot shapes, may be adsorbed inside the surface cover 260 or on a vertical surface 20 and then cradled.

The adsorption portion 300 may be provided on the surface of the back housing 250 in various shapes. For example, the adsorption portion 300 may be provided throughout the entire surface of the back housing 250 (see FIG. 10). The adsorption portion 300 may be provided along the periphery of the surface of the back housing 250 in a donut shape (see FIG. 11). The adsorption portion 300 may be provided as plates, which have a predetermined size, and which are formed on the surface of the back housing 250 to be spaced from each other (see FIG. 10). Although not illustrated, the adsorption portion 300 may also be positioned only in a partial position on the back housing 250, for example, only on the center part. Alternatively, adsorption portions 300 may positioned on the surface of the back housing 250 to be adjacent to each other along the longitudinal direction of the longer side (see figure FIG. 12), or may be positioned in a direction perpendicular to the longitudinal direction (see FIG. 13).

When the adsorption portion 300 is formed throughout the entire surface of the back housing 250 as described above (see FIG. 10), the above-mentioned auxiliary adsorption portion 350 may interfere with the adsorption portion 300; therefore, the auxiliary adsorption portion 350 may not be provided on the surface cover 260, or may be provided on the surface cover 260 in such a range that the same does not interfere with the adsorption portion 300.

When the adsorption portion 300 is provided along the periphery of the surface of the back housing 250 in a donut shape (see FIG. 11), the auxiliary adsorption portion 350 may be provided in such a position that the same does not interfere with the adsorption portion 300, for example, positioned on the inner surface of the surface cover 260, which faces the inside of the adsorption portion 300.

When adsorption portions 300 are positioned on the surface of the back housing 250 to be adjacent to each other along the longitudinal direction of the longer side (see FIG. 12), or when positioned in a direction perpendicular to the longitudinal direction (see FIG. 13), the auxiliary adsorption portion 350 may be positioned on the inner surface of the surface cover 260, which faces the empty space between the adsorption portions 300.

An auxiliary adsorption portion 350 may be further provided on the inner surface of the surface cover 260 (see FIG. 9 to FIG. 11). The auxiliary adsorption portion 350 according to the second embodiment of the present invention may be provided in such a position that the same does not interfere with the adsorption portion 300. The auxiliary adsorption portion 350 may include a nano suction gel material, like the adsorption portion 300, as will be described later.

Figure 14:
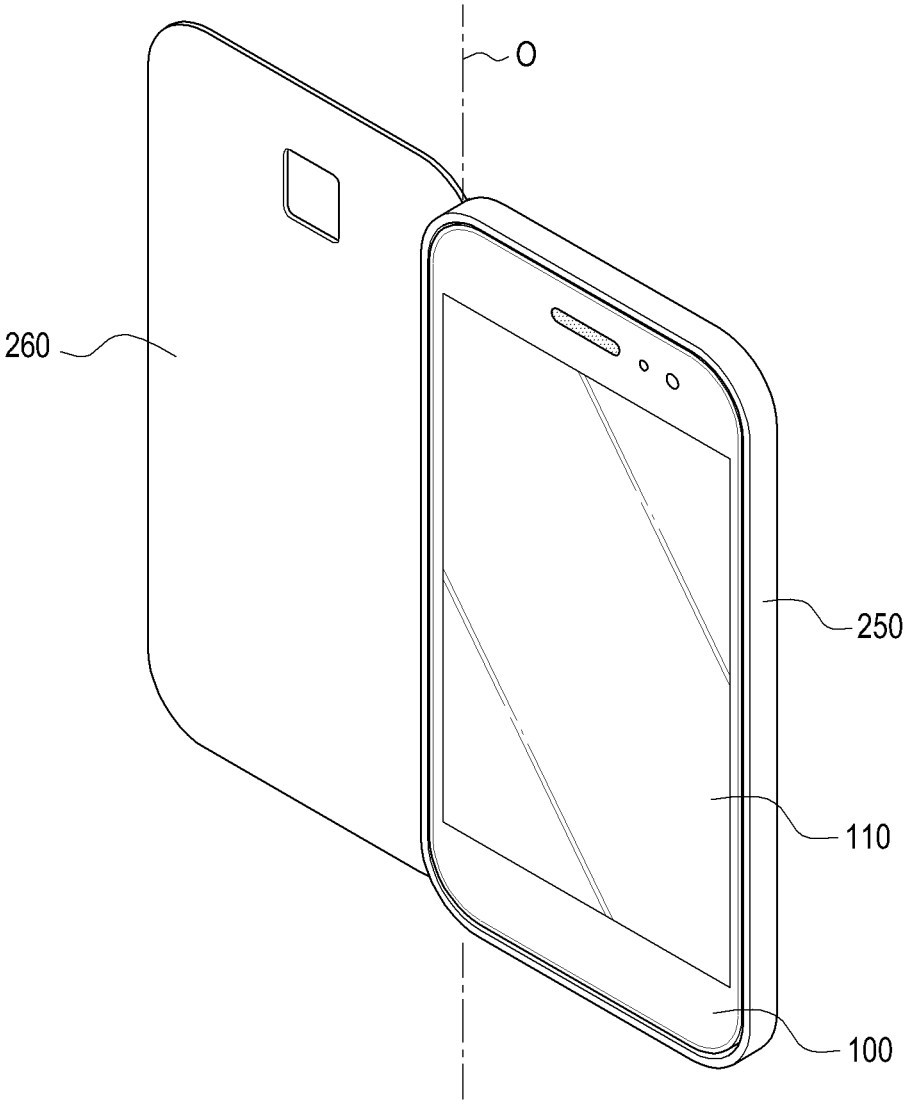
FIG. 14 is a diagram illustrating an electronic device having a protection cover according to the second embodiment among various embodiments of the present invention, the electronic device being cradled on a vertical surface.
Figure 15:
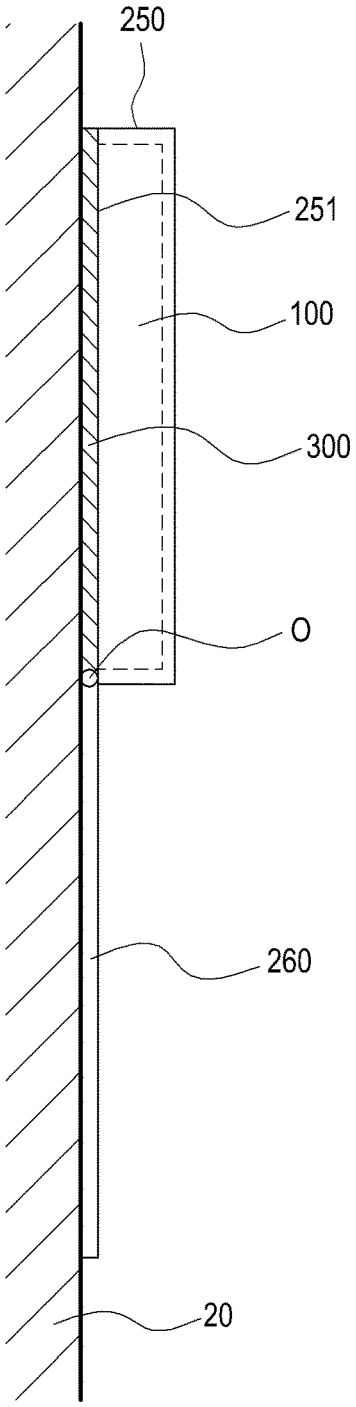
FIG. 15 is a sectional view illustrating an electronic device having a protection cover according to the second embodiment among various embodiments of the present invention, the electronic device being cradled on a vertical surface.

FIG. 14 is a drawing illustrating an electronic device having a protection cover according to the second embodiment among various embodiments of the present invention, the electronic device being cradled on a vertical surface. FIG. 15 is a sectional view illustrating an electronic device having a protection cover according to the second embodiment among various embodiments of the present invention, the electronic device being cradled on a vertical surface.

Referring to FIG. 14 and FIG. 15, while an electronic device is mounted on the protection cover 200 according to the second embodiment of the present invention, the surface of the back housing 250 may be covered by the surface cover 260. When the surface cover 260 covers the surface of the back housing 250, the adsorption portion 300, which is provided on the surface of the back housing 250, is adsorbed on the surface cover 260 such that the surface cover 260 remains retained on the back housing 250. While the surface cover 260 covers the surface of the back housing 250 and remains adsorbed thereon, the user can carry and use the electronic device normally.

When the user needs to use a multimedia function, for example, moving pictures, while freely using both hands, the user can cradle the electronic device on a vertical surface 20 and use the same. In order to cradle the electronic device on a vertical surface 20 and use the same, the user rotates the surface cover 260, which covers the surface of the back housing 250, away from the back housing 250. When the surface cover 260 rotates about the rotation shaft O away from the back housing 250, the surface of the back housing 250 is exposed to the outside and enables the adsorption portion 300, which is mounted on the surface of the back housing 250, to be exposed to the outside.

The user makes the adsorption portion 300 adsorbed on a vertical wall such that the rotated surface cover 260 is positioned on the lower portion of the electronic device. The back housing 250, on which the electronic device is mounted, is adsorbed and retained on the vertical surface 20 such that the user can watch multimedia through the electronic device cradled on the vertical surface 20 using both hands freely.

Furthermore, when an auxiliary adsorption portion 350 is provided inside the surface cover 260, which has rotated away from the back housing 250, the auxiliary adsorption portion 350 can be adsorbed on the vertical surface 20 together when the adsorption portion 300, which is provided on the back surface of the back housing 250, is adsorbed on the vertical surface 20. When the auxiliary adsorption portion 350 is adsorbed on the vertical surface 20 together with the adsorption portion 300, the electronic device can remain retained on the vertical surface 20 more stably, and the auxiliary adsorption portion 350 prevents the surface cover 260 from playing.

Hereinafter, a protection cover 200 according to the third embodiment among various embodiments of the present invention will be described with reference to FIG. 16 to FIG. 20. It is to be noted, prior to description of the protection cover 200 according to the third embodiment of the present invention, that repeated description of the same configuration or structure as that of the electronic device having the protection cover 200 according to the first or second embodiment, described above, will be omitted herein for clarity of description.

Figure 16:
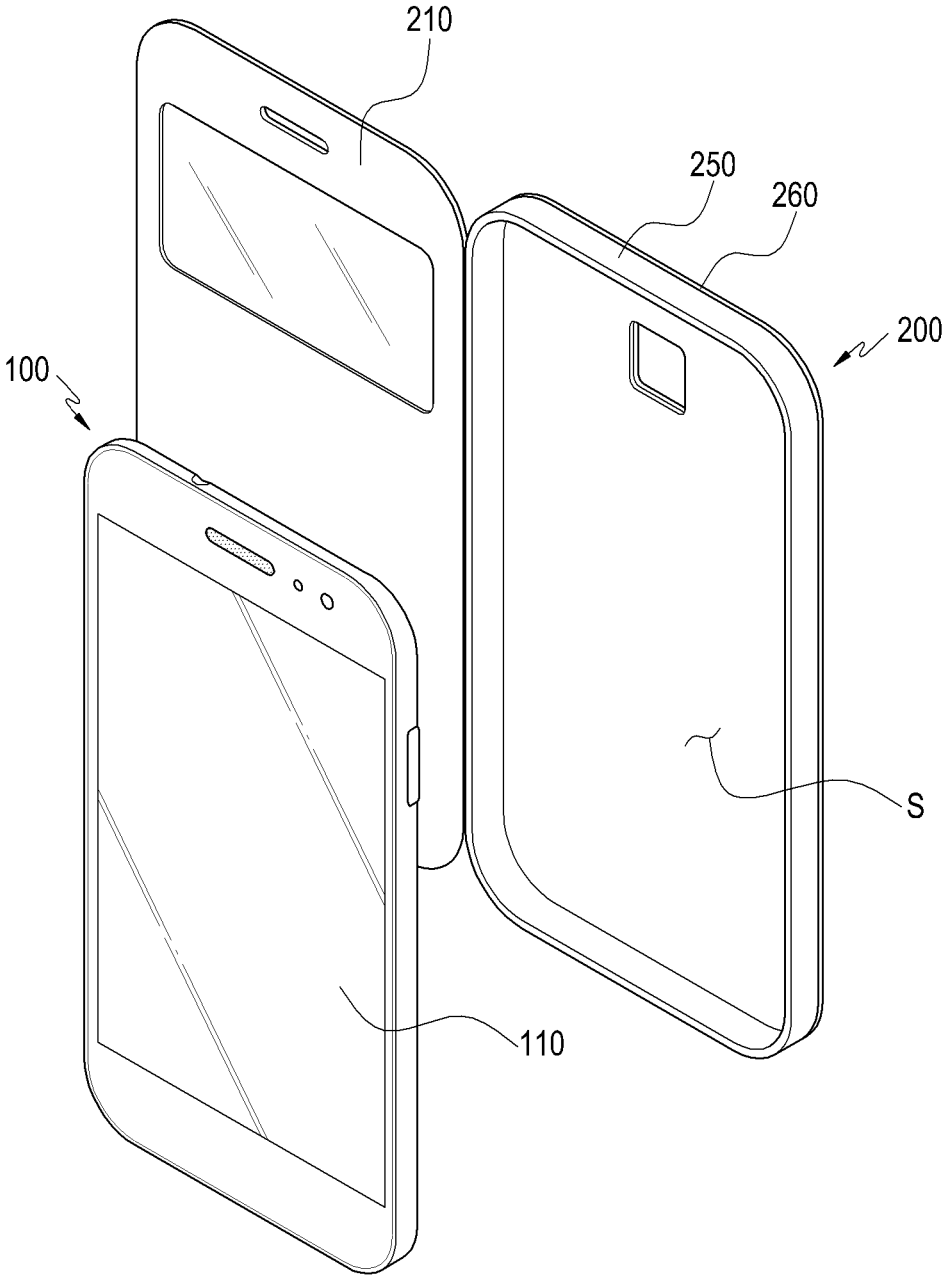
FIG. 16 is an exploded perspective view of an electronic device having a protection cover according to the third embodiment among various embodiments of the present invention, viewed from the front.
Figure 17:
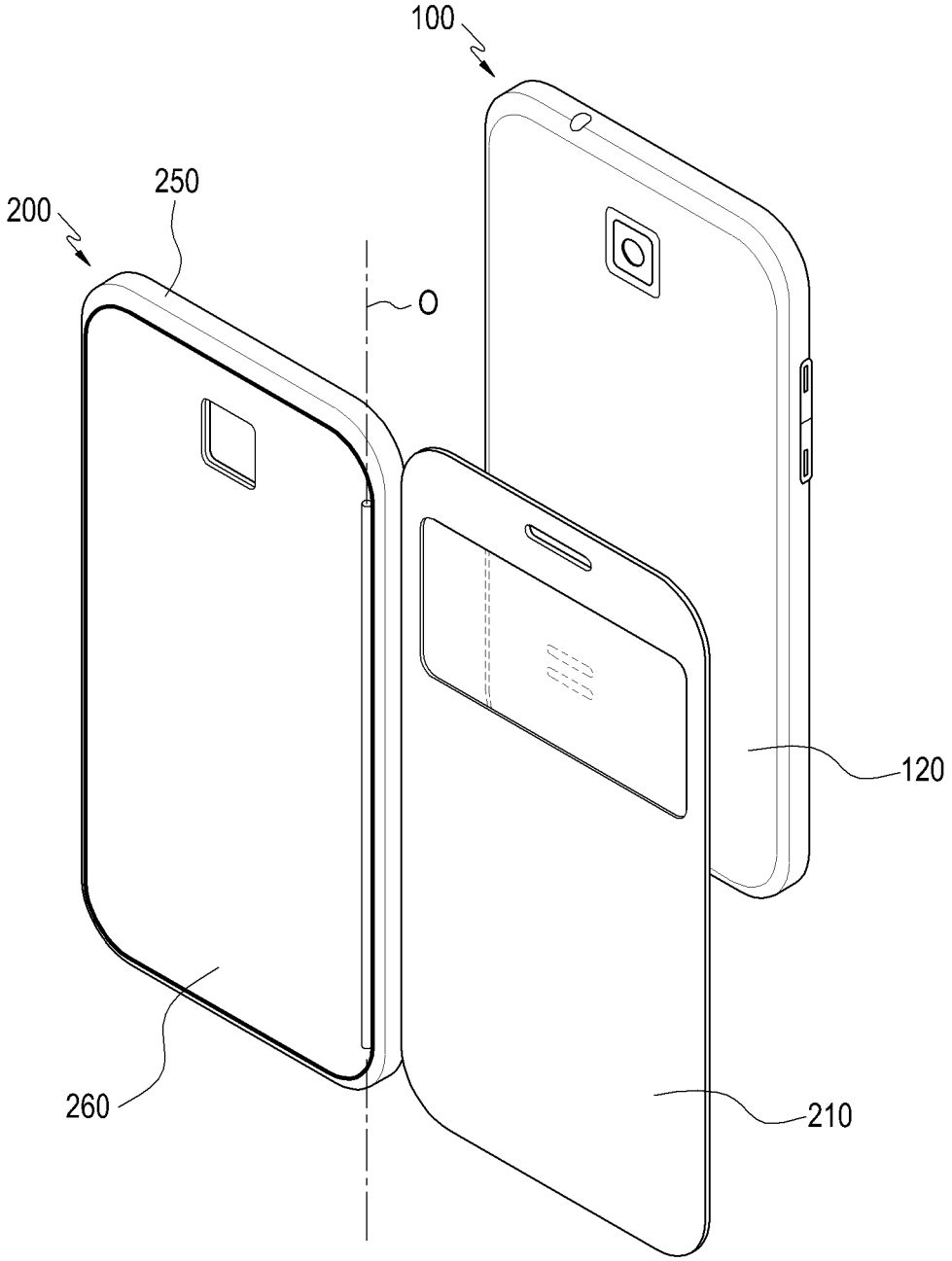
FIG. 17 is an exploded perspective view of an electronic device having a protection cover according to the third embodiment among various embodiments of the present invention, viewed from the rear.
Figure 18:
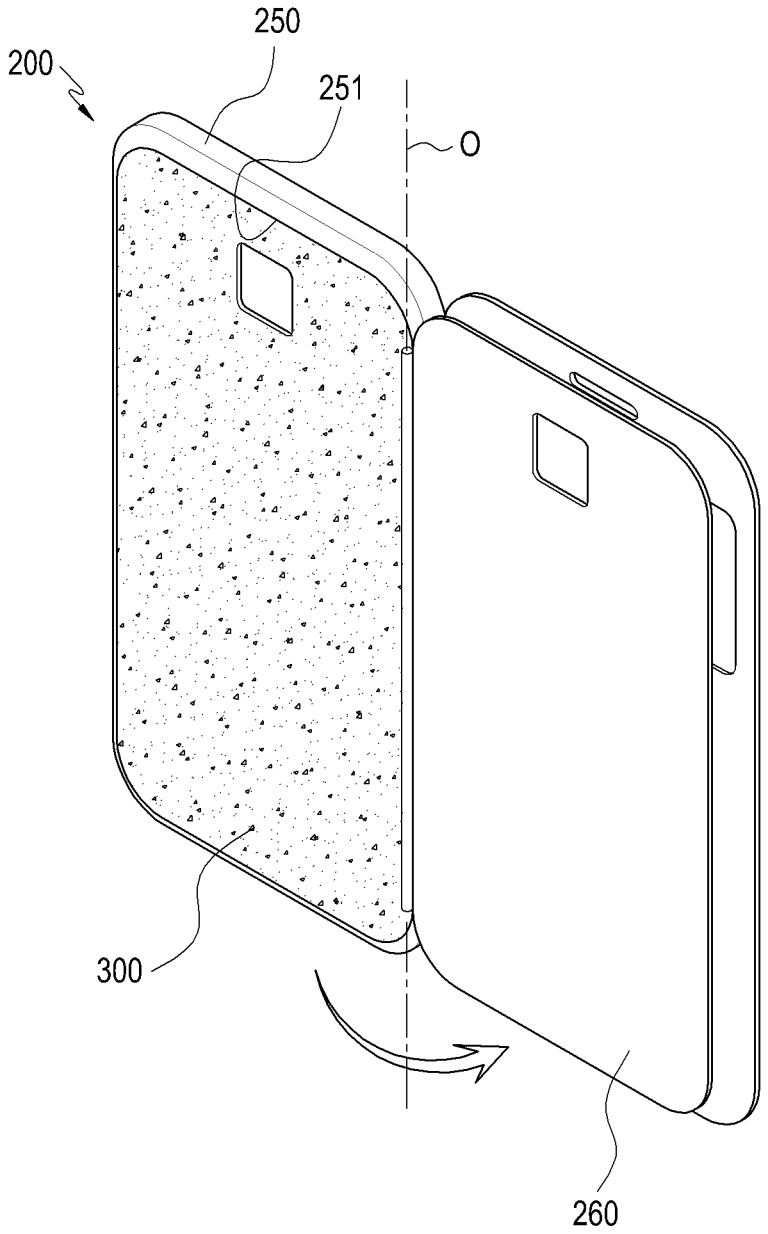
FIG. 18 is a perspective view illustrating a protection cover according to the third embodiment among various embodiments of the present invention.

FIG. 16 is an exploded perspective view of an electronic device having a protection cover according to the third embodiment among various embodiments of the present invention, viewed from the front. FIG. 17 is an exploded perspective view of an electronic device having a protection cover according to the third embodiment among various embodiments of the present invention, viewed from the rear. FIG. 18 is a perspective view illustrating a protection cover according to the third embodiment among various embodiments of the present invention.

Referring to FIG. 16 to FIG. 18, the protection cover 200 according to the third embodiment of the present invention is provided as a flip-type cover as in the case of the protection cover 200 according to the first embodiment, but is different in terms of the structure, type, and the like of the back cover 250 and 260 and the adsorption portion 300 according to the first embodiment. Specifically, the protection cover 200 according to the third embodiment of the present invention may be provided to include a back housing 250 and a surface cover 260 as in the case of the back cover 250 and 260 according to the second embodiment, and the adsorption portion 300 may have the same structure, type, or shape as that of the second embodiment. Therefore, differences between the protection cover 200 according to the third embodiment of the present invention and those according to the previous embodiments will now be described, and repeated description of the same configuration, structure, or shape will be omitted herein for clarity of description.

The protection cover 200 according to the third embodiment of the present invention may include a cover portion 210, 250, and 260 and an adsorption portion 300. The cover portion 210, 250, and 260 according to the third embodiment of the present invention may be provided in a flip cover shape. Specifically, the cover portion 210, 250, and 260 according to the third embodiment of the present invention may include a front cover 210 and a back cover 250 and 260, and the back cover 250 and 260 may include a back housing 250 and a surface housing 260.

The front cover 210 is rotatably provided on the back cover 250 and 260, particularly on one side of the back housing 250 such that, when rotated away from the back housing 250, the front cover 210 exposes/covers the display portion 110 provided on the front surface of the body portion 100.

The back housing 250 and the surface cover 260 may have structures similar to those according to the second embodiment described above, and repeated description of the detailed configuration or driving will be omitted herein.

Therefore, the protection cover 200 according to the third embodiment of the present invention includes a back cover 250 and 260, which includes a back housing 250 and a surface cover 260, similarly to the protection cover 200 according to the second embodiment, but is different from the protection cover 200 according to the second embodiment in terms of the front cover 210 rotatably provided on one side of the back cover 250 and 260.

Figure 19:
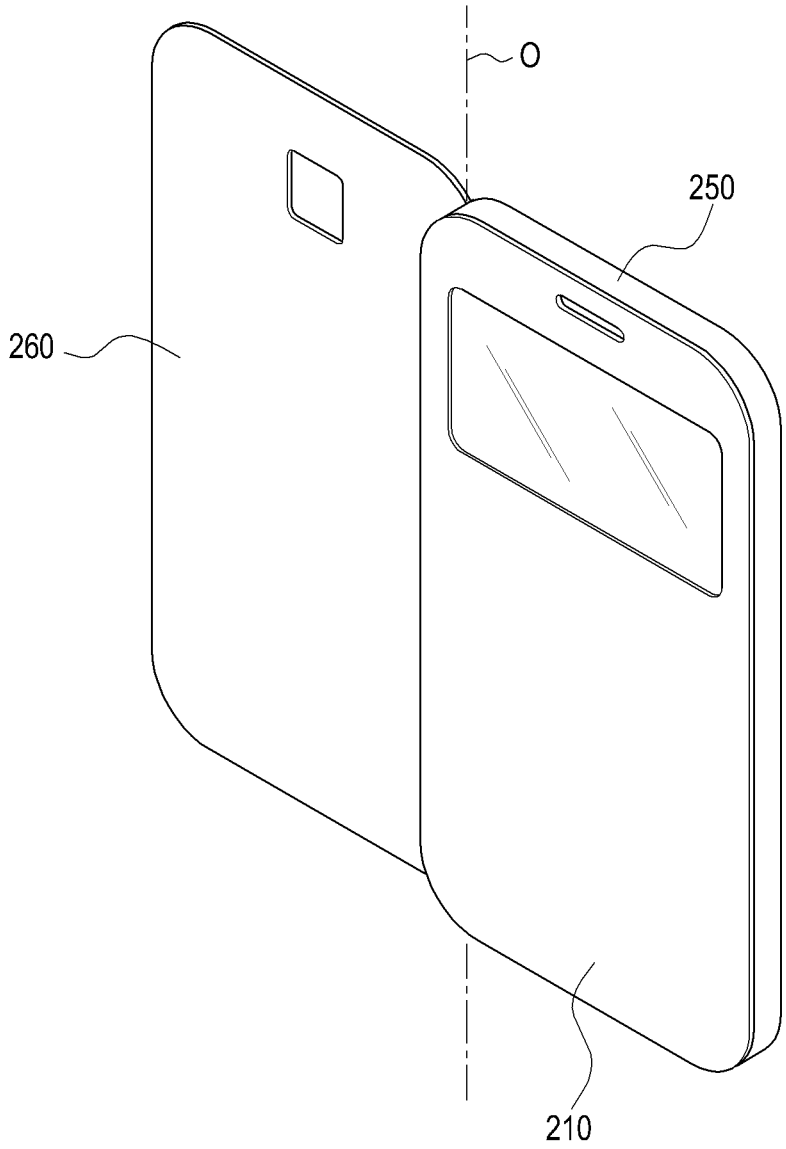
FIG. 19 is a diagram illustrating an electronic device having a protection cover according to the third embodiment among various embodiments of the present invention, when the front cover protects the display portion, and when the surface cover has rotated.

FIG. 19 is a diagram illustrating an electronic device having a protection cover according to the third embodiment among various embodiments of the present invention, when the front cover protects the display portion, and when the surface cover has rotated.

Referring to FIG. 19, the adsorption portion 300 according to the third embodiment of the present invention may be configured similarly to the configuration of the adsorption portion 300 according to the second embodiment described above such that the same is provided on the surface of the back housing 250. In addition, although not illustrated, a first adsorption portion 310 may be provided on the inner surface of the front cover 210 as in the case of the first embodiment. Therefore, while the front cover 210 is folded on the display portion 110, the first adsorption portion 310 may be adsorbed on the surface of the display portion 110, thereby retaining the front cover 210. Furthermore, the back housing 250 is covered by the surface cover 260, and the surface cover 260 may be retained on the back housing 250 by the adsorption portion 300, which is mounted on the surface of the back housing 250. The electronic device, on which the protection cover 200 is mounted, can be carried in this state; when the user releases the first adsorption portion 310, which has been adsorbed on the surface of the display portion 110, and when the front cover 210 is then rotated away from the back housing 250, the display portion 110 is available.

Figure 20:
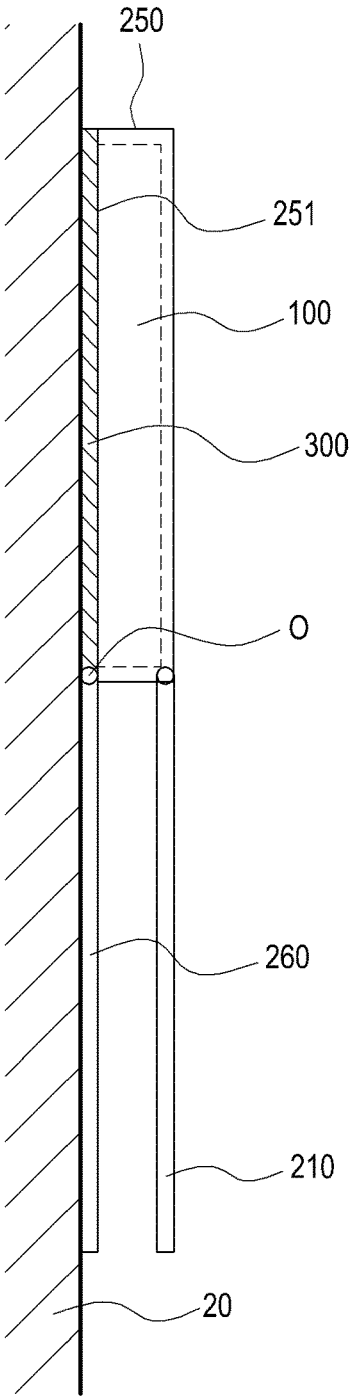
FIG. 20 is a diagram illustrating an electronic device having a protection cover according to the third embodiment among various embodiments of the present invention, the electronic device being retained on a vertical surface.

FIG. 20 is a diagram illustrating an electronic device having a protection cover according to the third embodiment among various embodiments of the present invention, the electronic device being cradled on a vertical surface.

Referring to FIG. 20, the user can cradle the electronic device on a vertical surface 20 and use the same, in order to use a multimedia function, such as moving pictures, while freely using both hands. In order to cradle the electronic device on a vertical surface 20 and to use the same, the user rotates the surface cover 260, which covers the surface of the back housing 250, away from the back housing 250. When the surface cover 260 is rotated about the rotation shaft O away from the back housing 250, the surface of the back housing 250 is exposed to the outside such that the adsorption portion 300, which is mounted on the surface of the back housing 250, can be exposed to the outside.

The user makes the adsorption portion 300 adsorbed on the vertical wall such that that the rotated surface cover 260 is positioned on the lower portion of the electronic device. As the back housing 250, on which the electronic device is mounted, is adsorbed and retained on the vertical surface 20, the user can watch multimedia through the electronic device, which is cradled on the vertical surface 20, freely using both hands.

When an auxiliary adsorption portion 350 is provided inside the surface cover 260, which has rotated away from the back housing 250, the auxiliary adsorption portion 350 can be adsorbed on the vertical surface 20 together when the adsorption portion 300, which is provided on the back surface of the back housing 250, is adsorbed on the vertical surface 20. When the auxiliary adsorption portion 350 is adsorbed on the vertical surface 20 together with the adsorption portion 300, the electronic device can remain retained on the vertical surface 20 more stably, and the auxiliary adsorption portion 350 prevents the surface cover 260 from playing.

Embodiments of the present invention provided in the present specifications and drawings are merely certain examples to readily describe the technology associated with embodiments of the present invention and to help understanding of the embodiments of the present invention, but may not limit the scope of the embodiments of the present invention. Therefore, in addition to the embodiments disclosed herein, the scope of the various embodiments of the present invention should be construed to include all modifications or modified forms drawn based on the technical idea of the various embodiments of the present invention.

The invention claimed is:

1. A protection cover that protects an electronic device, the protection cover comprising:

a front cover configured to be positioned on a front surface of the electronic device;

a back cover connected to the front cover and configured to be positioned on a back surface of the electronic device; and a connection member that rotatably connects the front cover to the back cover, wherein the protection cover comprises a suction portion provided on the front cover and on the connection member so as to retain the protection, which is provided with the electronic device, on a vertical surface, wherein the front cover comprises an inner surface configured to face the front surface of the electronic device when the front cover is folded on the front surface of the electronic device, wherein the suction portion comprises a first suction portion provided on the inner surface of the front cover and a second suction portion provided on the connection member, wherein the first suction portion comprises a compression member including a rubber material and a nano suction gel material, and wherein the second suction portion comprises a compression member including a nano suction gel material.

2. The protection cover as claimed in claim 1, wherein the connection member comprises two split surfaces, and the second suction portion is provided on a split surface adjacent to the front cover, among the split surfaces.

3. The protection cover as claimed in claim 2, wherein, when the front cover rotates with regard to the back cover and faces the back cover, the first suction portion and the second suction portion form an identical surface and are retained on a vertical surface.

4. The protection cover as claimed in claim 1, wherein the first suction portion is configured to face a display portion of the electronic device such that the front cover retained on the display portion.

5. The protection cover as claimed in claim 4, wherein the first suction portion comprises:

a first suction plate, which has a curvature surface that is recessed inwards, and which forms an opening; and a second suction plate, which is mounted in the opening, which has a curvature surface that is connected to the curvature surface of the first suction plate, and which is made of a heterogeneous material that has a relatively higher suction force compared with the first suction plate.

6. The protection cover as claimed in claim 5, wherein the second suction plate is provided to have a suction force that gradually increases from an end of the front cover towards the connection member.

7. A protection cover that protects an electronic device, the protection cover comprising:

a back housing configured to surround the electronic device and cover a back surface of the electronic device;

a surface cover rotatably provided on a surface of the back housing so as to expose the surface of the back housing according to a rotation; and a suction portion provided on the surface of the back housing so as to retain the back housing, which is provided with the electronic device, on a vertical surface, wherein the suction portion comprises a compression member including a nano suction gel material.

8. The protection cover as claimed in claim 7, wherein the suction portion is provided throughout the entire surface of the back housing, at least one or more suction portions are provided on a partial surface of the surface of the back housing, or the suction portion is provided along a peripheral surface of the surface of the back housing.

9. The protection cover as claimed in claim 8, further comprising an auxiliary suction portion on an inner surface of the surface cover.

10. The protection cover as claimed in claim 7, further comprising:

a front cover configured to be positioned on a front surface of the electronic device.

* * * * *